US009027918B2

(12) United States Patent
Komatsu et al.

(10) Patent No.: US 9,027,918 B2
(45) Date of Patent: May 12, 2015

(54) MEDIUM PROCESSOR HAVING MEDIUM STORING BOXES FLEXIBLY LOADABLE IN A SLOT OF A MEDIUM STORAGE

(71) Applicant: Oki Electric Industry Co., Ltd., Tokyo (JP)

(72) Inventors: Hirokazu Komatsu, Tokyo (JP); Ryousuke Kojima, Tokyo (JP); Shinji Ohara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/015,879

(22) Filed: Aug. 30, 2013

(65) Prior Publication Data

US 2014/0054848 A1 Feb. 27, 2014

Related U.S. Application Data

(63) Continuation-in-part of application No. 13/871,822, filed on Apr. 26, 2013.

(30) Foreign Application Priority Data

May 28, 2012 (JP) ..... 2012-120891
Apr. 9, 2013 (JP) ..... 2013-81221

(51) Int. Cl.
*B65H 3/44* (2006.01)
*B65H 1/04* (2006.01)
(Continued)

(52) U.S. Cl.
CPC ..... *B65H 31/24* (2013.01); *B65H 1/00* (2013.01); *B65H 1/04* (2013.01); *B65H 3/44* (2013.01); *B65H 83/025* (2013.01); *B65H 1/266* (2013.01);
(Continued)

(58) Field of Classification Search
CPC ..... G07D 11/0081; G07D 11/0006; B65H 1/266; B65H 3/44; B65H 1/04
USPC ..... 271/3.01, 9.11–9.13; 209/534; 194/206, 194/350; 235/379; 902/12, 13
See application file for complete search history.

(56) References Cited

U.S. PATENT DOCUMENTS 6,439,395 B1 * 8/2002 Voellmer et al. ..... 209/534
6,749,053 B2 * 6/2004 Ikuta ..... 194/206
(Continued)

FOREIGN PATENT DOCUMENTS

CN 1666235 A 9/2005
CN 1707532 A 12/2005
(Continued)

OTHER PUBLICATIONS

Partial English translation of foreign Office Action issued on Dec. 22, 2014.
(Continued)

*Primary Examiner* — Luis A Gonzalez
(74) *Attorney, Agent, or Firm* — Rabin & Berdo, P.C.

(57) ABSTRACT

A medium processor is provided with a medium storage which can house two small storing boxes next to each other and has plural slots into which the two small storing boxes can be detachably loaded. Thus, the two small storing boxes can be loaded in a space equivalent to one conventional bill storing box, and the small storing boxes can be detached for servicing even when there are two small storing boxes loaded in one slot. Thus, various kinds of media can be handled without impairing maintainability.

9 Claims, 22 Drawing Sheets

(51) Int. Cl.

| | |
|---|---|
| ***B65H 31/24*** | (2006.01) |
| ***B65H 1/00*** | (2006.01) |
| ***B65H 83/02*** | (2006.01) |
| ***B65H 1/26*** | (2006.01) |
| ***B65H 3/06*** | (2006.01) |
| ***B65H 5/26*** | (2006.01) |

(52) U.S. Cl.

CPC ..... *B65H 3/0607* (2013.01); *B65H 5/26* (2013.01); *B65H 2402/10* (2013.01); *B65H 2405/121* (2013.01); *B65H 2405/313* (2013.01); *B65H 2405/332* (2013.01); *B65H 2701/1912* (2013.01)

(56) References Cited

U.S. PATENT DOCUMENTS

| | | | | |
|---|---|---|---|---|
| 7,249,707 | B2 | 7/2007 | Yokoi et al. | |
| 7,255,216 | B2 | 8/2007 | Izawa et al. | |
| 7,322,518 | B2 * | 1/2008 | Yokoi et al. | 235/379 |
| 7,673,874 | B2 * | 3/2010 | Arai et al. | 271/258.01 |
| 7,694,797 | B2 * | 4/2010 | Takeuchi et al. | 194/206 |
| 7,976,005 | B2 | 7/2011 | Ichikawa et al. | |
| 8,256,624 | B2 * | 9/2012 | Doi et al. | 209/534 |
| 8,276,901 | B2 * | 10/2012 | Taniguchi et al. | 270/60 |
| 8,369,986 | B2 | 2/2013 | Doi | |
| 8,454,009 | B2 * | 6/2013 | Nagura et al. | 271/207 |
| 2008/0150216 | A1 | 6/2008 | Ichikawa et al. | |
| 2012/0104679 | A1 | 5/2012 | Blair et al. | |
| 2012/0285787 | A1 * | 11/2012 | Hosokawa et al. | 194/206 |
| 2013/0001039 | A1 * | 1/2013 | Mizushima et al. | 194/206 |

FOREIGN PATENT DOCUMENTS

| | | | | |
|---|---|---|---|---|
| CN | 101965593 | A | | 2/2011 |
| CN | 102254362 | A | | 11/2011 |
| JP | H01-271332 | A | | 10/1989 |
| JP | 05162865 | A | * | 6/1993 |
| JP | H05-162865 | A | | 6/1993 |

OTHER PUBLICATIONS

Foreign Office Action issued on Dec. 22, 2014.

* cited by examiner

MEDIUM PROCESSOR HAVING MEDIUM STORING BOXES FLEXIBLY LOADABLE IN A SLOT OF A MEDIUM STORAGE

BACKGROUND OF THE INVENTION

1. Field of the Invention

The present invention relates to a medium processor, and specifically to a machine included in an automatic transaction apparatus or the like which treats media such as sheet-like media, e.g. bills.

2. Description of the Background Art

For example, as shown in FIG. 14, a conventional automatic transaction apparatus has a bill depositing and withdrawing machine 200 which consists of an upper housing 201 and a lower housing 202. The upper housing 201 has a bill inlet-outlet 203 for receiving and discharging bills; a discriminator 204 for determining the authenticity, denominations and the like of bills; and a temporary storage 205 for temporarily storing bills. The lower housing 202 has a bill storage 208 provided therein which includes a plurality of bill storing boxes 206 for storing bills therein denomination by denomination; and a repository 207 for storing abnormal bills such as rejected bills returned from the bill depositing and withdrawing machine 200.

The upper and lower housings 201 and 202 also have a conveyance channel 209 provided therethrough to communicate with the bill inlet-outlet 203, the discriminator 204, the temporary storage 205, the bill storing boxes 206 and the repository 207.

The conventional bill depositing and withdrawing machine 200 as above is designed specifically for use in a predetermined country, Japan in this example. For example, the bill depositing and withdrawing machine 200, thus specific to use in Japan, includes the five bill storing boxes 206 according to the Japanese denominations. The five bill storing boxes 206 are arranged in the lower housing 202 in the fore-and-aft direction as shown in FIG. 14, and can be individually detached from the lower housing 202 for maintenance. Note that in FIG. 14 the front of the depositing and withdrawing machine 200 is indicated by an arrow 230 whereas the back of the machine 200 is by an arrow 232.

However, the bill depositing and withdrawing machine 200 of the Japanese specifications has a problem that it cannot be used in countries other than Japan because some countries may have more denominations than Japan and hence the five bill storing boxes 206 are not satisfactory.

For this problem, U.S. Pat. No. 7,976,005 B2 to ICHIKAWA et al, for example, proposes a bill storing box 306 as shown in FIG. 15. The bill storing box 306 has two repositories 307 and 308 arranged in its upper and lower portions, respectively, and thus can store two denominations of bills while being sorted thereinside.

The bill storing box 306 having two repositories 307 and 308 reduces the storage capacity of bills of respective denominations but can increase the number of denominations, for example, from five to ten without changing the size of the lower housing 202, whereby the bill depositing and withdrawing machine with the bill storing box 306 can handle various kinds of bills of various countries at low costs.

However, due to the two repositories 307 and 308 being included in one bill storing box 306, the box 306 has a trouble that, when one repository 307 or 308 becomes full of bills and requires maintenance, there is a necessity to detach the entire bill storing box 306 from the bill depositing and withdrawing machine for maintenance. The bill storing box 306 having two repositories thus enables the bill depositing and withdrawing machine to handle more denominations, but requires more maintenance.

SUMMARY OF THE INVENTION

It is an object of the present invention to provide a medium processor that can handle various media, particularly sheet-like media, without impairing the maintainability.

In accordance with the present invention, a medium processor comprises a conveyance channel conveying a medium; at least two removable medium-storing boxes for storing the medium conveyed on the conveyance channel; and medium storage having at least one slot for detachably housing the two medium-storing boxes such that they are arranged next to each other.

Also, in accordance with the present invention, a medium-storing box for storing a medium includes an upper and a lower medium-entering and exiting slot arranged in a top and a bottom portion of the medium-storing box, respectively; and an in-box conveyance channel arranged for connecting the upper medium entering and exiting slot to the lower medium entering and exiting slot.

Further, in accordance with the present invention, a medium-storing box for storing a medium includes an upper medium-entering and exiting slot arranged in a top portion of the medium-storing box, and, when the medium-storing box is loaded in an lower portion of the slot under an upper small storing box, the upper medium-entering and exiting slot connects to a lower medium-entering and exiting slot arranged in a bottom portion of the upper small storing box.

The bill processor according to the present invention can have a plurality of medium-storing boxes flexibly loaded in the slot where only one conventional medium-storing box could be loaded. Also, since the plurality of medium-storing boxes can be individually attached to or detached from the slot, the medium-storing box can be detached and individually rendered for servicing even when there are a plurality of medium-storing boxes loaded in the slot.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
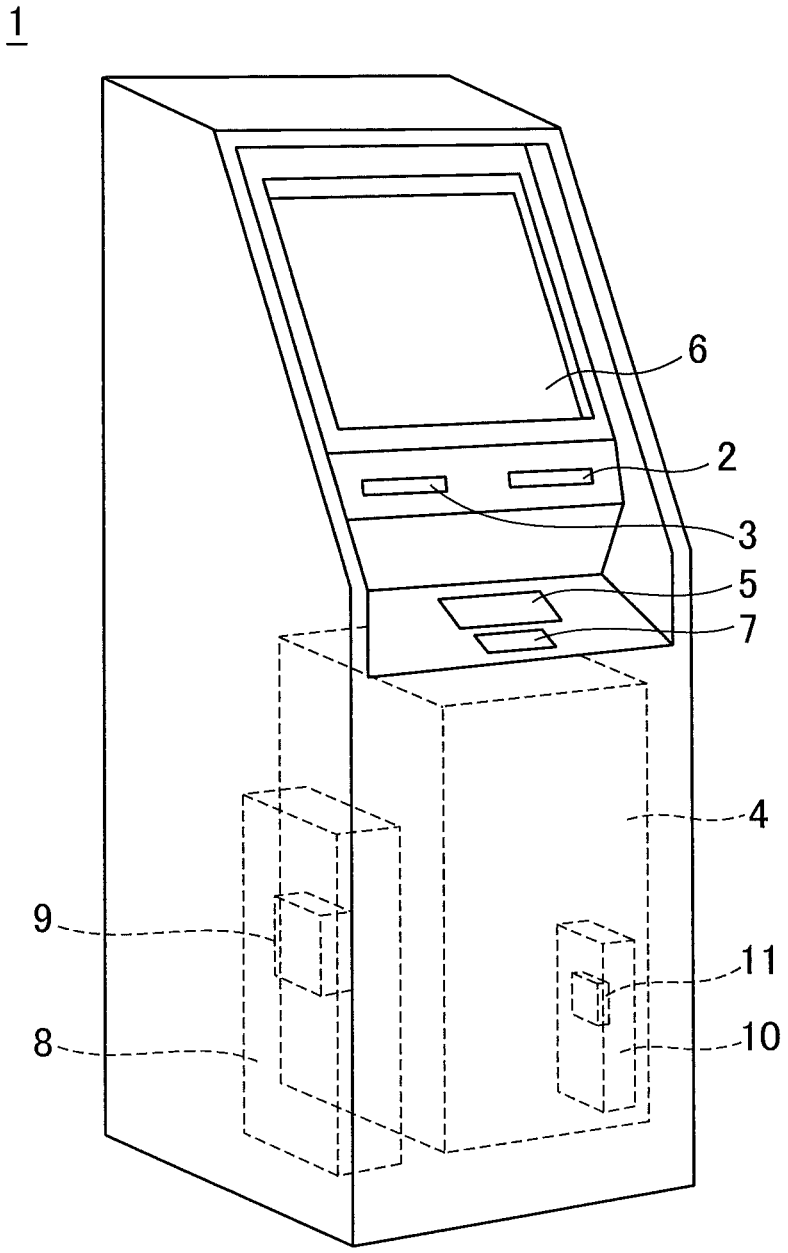
FIG. 1 is a schematic perspective view showing an automated teller machine to which the present invention is applied as a preferred embodiment.

Now, a preferred embodiment of the present invention will be described in detail with reference to the accompanying drawings. In the figures, components and elements are merely schematically depicted to the extent that the present invention can be sufficiently understood. Therefore, the present invention is not to be restrictively comprehended only by the illustrated embodiments. In the description and drawings, like components and elements are designated with the same reference numerals, and repetitive descriptions thereon will be refrained from.

FIG. 1 schematically shows an automatic teller machine (ATM) 1, which is adapted to handle transaction media, especially sheet-like media such as cash cards, bills, account statements and so on, and is operative in response to customer's operation to process transactions such as depositing and payment of cash and transfer of fund.

The ATM 1 has a card processor and a printer, both not shown, which are provided in the upper portion of the ATM 1. In the illustrative embodiment, the card processor is for use in dealing with a plastic card, such as a cash card, of the customer, which may be received by a card inserting/returning slot 2 provided in the front surface, facing to the customer, of the ATM 1. The printer is for use in printing a bank statement, or transaction slip, to issue the statement to the customer from a receipt issuing slot 3 provided in the front surface of the ATM 1.

The ATM 1 also has a bill depositing and withdrawing machine 4 provided in its lower portion for processing bills, and a shutter 5 provided on the front surface above the bill depositing and withdrawing machine 4 so that the shutter 5 opens and closes in order to deposit and withdraw bills.

The ATM 1 further has an operation display 6, a key pad 7, a main controller 8 and a memory 9. The operation display 6 is for use in displaying transaction contents and guidance to the customer and to receive input information and items for transactions in response to the customer's manipulation. The key pad 7 may be a numeric keypad, by using which the customer can input his or her identification (ID) number and so on. The operation display 6 and the key pad 7 are provided on the front surface of the ATM 1.

The main controller 8 is adapted to control the entire ATM 1 and also various components of the ATM 1. The memory 9 is adapted for storing operational information of the ATM 1. As shown in FIG. 1, the main controller 8 and the memory 9 are provided in the ATM 1.

The ATM 1 may include some other components. For example, in the illustrative embodiment, the ATM 1 further has, in addition to the main controller 8 and memory 9, another controller 10 and another memory 9 provided in the bill depositing and withdrawing machine 4. The latter controller 10 is adapted for controlling the bill depositing and withdrawing machine 4, and the latter memory 11 is for working as a storage area for the controller 10.

Next, reference will be made to FIG. 2 for use in describing the bill depositing and withdrawing machine 4. In the illustrative embodiment, the bill depositing and withdrawing machine 4 is a so-called recycle-type bill depositing and withdrawing machine that uses deposited bills as bills to be withdrawn to the customer.

Figure 2:
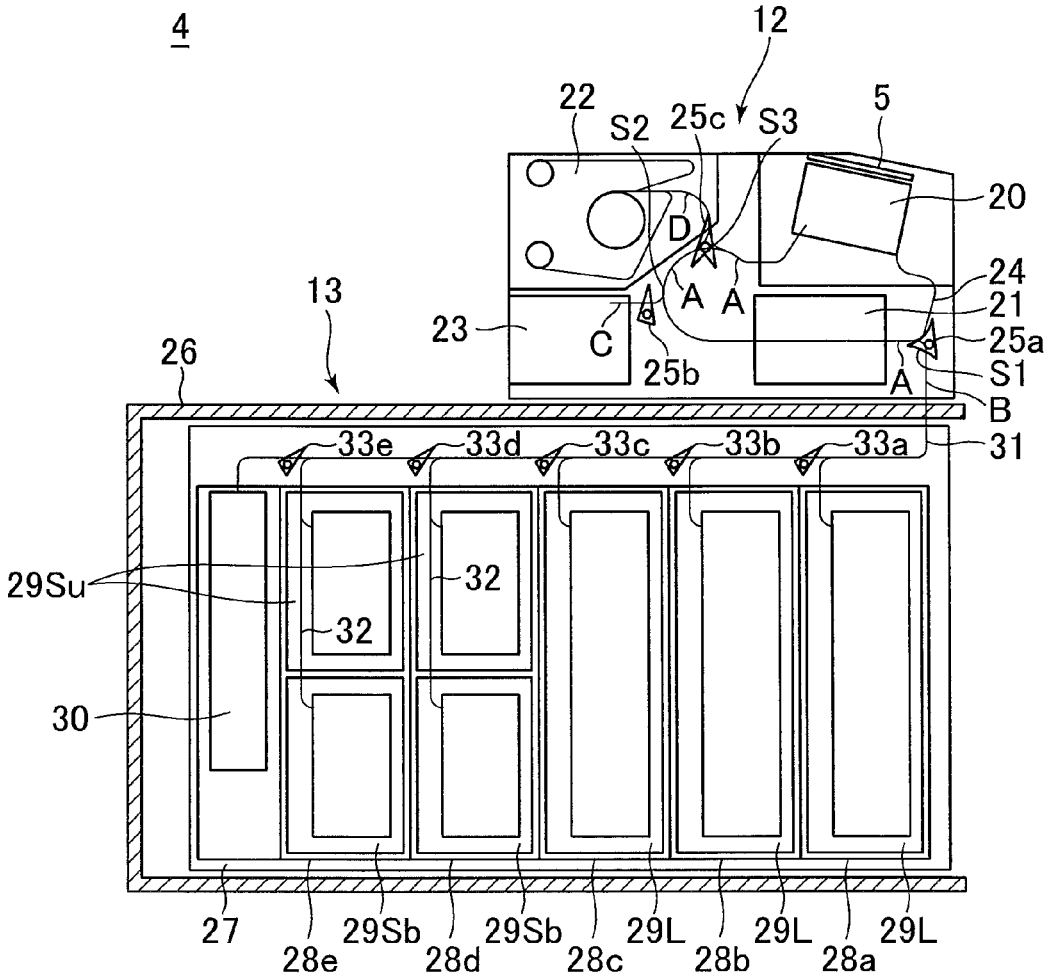
FIG. 2 is a schematic side view showing the inner configuration of an embodiment of a bill depositing and withdrawing machine according to the present invention.

As shown in FIG. 2 the bill depositing and withdrawing machine 4 has an upper housing 12 on its upper portion, a lower housing 13 on its lower portion, and the controller 10 which is not shown in FIG. 2. The upper housing 12 has an inlet-outlet 20 at the upper portion of the front surface of the upper housing 12. The inlet-outlet 20 serves as bill receiving and discharging port and has the shutter 5, mentioned above, placed over the inlet-outlet 20.

The upper housing 12 also has a discriminator 21, a temporary storage 22 and a repository 23. The discriminator 21 is arranged below the inlet-outlet 20 and is adapted for determining the authenticity and denominations of bills, whether or not bills are damaged, how bills are mechanically conveyed and the like. The temporary storage 22 is arranged in the rear of the inlet-outlet 20 and is for use in temporarily storing bills. The repository 23 is arranged adjacent to and below the temporary storage 22 and is for use in storing abnormal bills such as rejected bills which are to be returned from the bill depositing and withdrawing machine 4 to the customer.

The upper housing 12 further includes a conveyance channel 24 communicating with the bill inlet-outlet 20, the discriminator 21, the temporary storage 22 and the repository 23. This conveyance channel 24 may be referred to as upper conveyance channel.

Specifically, as shown in FIG. 2, the upper conveyance channel 24 is connected to the inlet-outlet 20 at the front of its bottom surface, and extends therefrom downward to a bifurcation S1 where the conveyance channel 24 branches into a lateral conveyance channel A connected to the discriminator 21 and a downward conveyance channel B connected to the lower housing 13.

The lateral conveyance channel A of the conveyance channel 24 then passes through the discriminator 21 and takes a curve upwardly to be connected to the inlet-outlet 20 at the rear of its bottom surface. As shown in FIG. 2, the curved conveyance channel A has two bifurcations S2 and S3 arranged therein: one bifurcation S2 being arranged at the center of the curved conveyance channel A; and the other bifurcation S3 being arranged at the upper end of the curved conveyance channel A. At the one bifurcation S2, the conveyance channel 24 branches into the curved conveyance channel A and a lateral conveyance channel C connected to the repository 23. Similarly, at the other bifurcation S3, the conveyance channel 24 branches into the curved conveyance channel A and a upward conveyance channel D connected to the temporary storage 22.

These bifurcations S1, S2 and S3 have switches 25*a*, 25*b* and 25*c* arranged therein, respectively. The switch 25*a* in the bifurcation S1 is capable of switching a bill conveyance direction between the lateral direction on the lateral conveyance channel A and the downward direction on the downward conveyance channel B. The switch 25*b* in the bifurcation S2 is capable of switching the bill conveyance direction between the upward direction on the curved conveyance channel A, the lateral direction on the lateral conveyance channel C and the downward direction on the lateral conveyance channel A passing through the discriminator 21. The switch 25*c* in the bifurcation S3 is capable of switching the bill conveyance direction between the upward direction on the curved conveyance channel A, the downward direction on the curved conveyance channel A connected to the inlet-outlet 20, the upward direction on the upward conveyance channel D connected to the temporary storage 22 and the downward direction on the curved conveyance channel A connected to the bifurcations S2. In the illustrative embodiment, these switches 25*a*, 25*b* and 25*c* are controlled by the controller 10 to switch the bill conveyance direction according to the destination of bills.

As seen from FIG. 2, the lower housing 13 is a cashbox 26 surrounded with thick steel plates and having a bill storage 27 arranged inside the cashbox 26. The bill storage 27 is arranged slidably in the fore-and-aft direction so that it can be pulled out from the front surface of the ATM 1, for example, for maintenance.

In the illustrative embodiment, the bill storage 27 is a vertical accumulation type where bills may be accumulated in the vertical direction in a bill storing box 29, which may be loaded into any of a plurality of longitudinal, or tall, slots 28 from above to be arranged therein in a vertical orientation. However, the present invention may not be limited to this specific arrangement, but the bill storage 27 may be a horizontal accumulation type where bills may be stored in the fore-and-aft direction into another type of bill storing box, which may be loaded in any of a plurality of lateral slots from sideways to be arranged in the horizontal orientation.

The bill storage 27 includes the plurality of longitudinal slots 28, a repository 30 and a conveyance channel 31. In the illustrative embodiment, the bill storage 27 has five longitudinal slots 28*a* to 28*e* arranged in the horizontal direction of the figure. Note that there may be any number of slots in the bill storage 27 so that, for example, the storage 27 may have four or less or six or more slots.

Each of the slots 28*a* to 28*e* may have one or more bill storing box/boxes 29 detachably loaded thereinto. For example, each of the slots 28*a*, 28*b* and 28*c* may have a bill storing box 29L loaded, which may have substantially the same size as the slot 28*a* whereas each of the slots 28*d* and 28*e* may have two bill storing boxes 29S loaded, which may be substantially half as long in the vertical direction as the bill storing box 29L. The bill storing boxes 29L and 29S may be referred to as large and small storing boxes, respectively.

Note that, in the illustrative embodiment, there are two types of small storing box 29S, one being for use in the lower portions of the slots 28*d* and 28*e*, and the other being for the upper portions of the slots 28*d* and 28*e*. Thus, as shown in FIG. 2, in those slots 28*d* and 28*e*, the small storing box for lower portion, i.e. lower small storing box, 29Sb may be loaded into the lower portions of the slots 28*d* and 28*e*, and the small storing box for upper portion, i.e. upper small storing box, 29Su may be loaded in the upper portions of the slots 28*d* and 28*e*. The slots 28*d* and 28*e* may have a single small storing box 29S loaded alone. In such a case, the lower portion of the slots 28*d* and 28*e* may be made vacant whereas the upper portion of the slots 28*d* and 28*e* may have the upper small storing box 29Su loaded.

In the illustrative embodiment, these storing boxes 29L, 29Su and 29Sb may have respective unique ID numbers whereby the controller 10 can distinguish them from each other.

The repository 30 is arranged in the rear of the rearmost slot 28*e* and is for use in storing abnormal bills such as rejected bills which are to be returned from the bill depositing and withdrawing machine 4 to the customer. The repository 30 may be a box like the bill storing boxes 29 and be detachable from the bill storage 27.

The conveyance channel 31, which may be referred to as lower conveyance channel, is arranged above the slots 28*a* to 28*e* and repository 30 to convey bills, and extends, as shown in FIG. 2, in the horizontal direction of the figure. In the illustrative embodiment, the conveyance channel 31 has its one end connected to the upper conveyance channel 24 and its other end connected to the bill storing boxes 29L and 29S and to the repository 30.

To the conveyance channel 31, a conveyance channel 32 is connected, which is arranged in the upper small storing boxes 29Su. When two small storing boxes 29Sb and 29Su are loaded into each of the slots 28*d* and 28*e*, the lower small storing boxes 29Sb is connected to the lower conveyance channel 31 via the conveyance channel 32, which may be referred to as internal conveyance channel.

In the conveyance channel 31, there are a plurality of switches 33, that is, five switches 33*a* to 33*e* in the illustrative embodiment, arranged on the bifurcations of the conveyance channel 31. These switches 33*a* to 33*e* are capable of switching a bill conveyance direction between the direction to the conveyance channel 24, the downward direction to the bill storing boxes 29 and the direction to the other switches 33 or the repository 30. In the illustrative embodiment, these switches 33 to 33*e* are controlled by the controller 10 to switch the bill conveyance direction according to the destination of bills.

The controller 10, FIG. 1, is adapted to control the components installed in the upper and lower housings 12 and 13 to perform bill depositing and withdrawing processes based on the results of the discriminator 21.

In the bill depositing and withdrawing machine 4 configured in this way, bills input from the bill inlet/outlet 20 are stored or fed out in the fashion as exemplified below. For example, when the customer inserts his or her cash card or the like into the ATM 1 in order to conduct a transaction such as deposition, and operates the operation display 6 by touching a transaction item, for example, "deposition", on the display screen, the shutter 5 is opened so that he or she may insert bills in lump into the bill inlet/outlet 20. Then, the shutter 5 is closed and the bills received by the bill inlet/outlet 20 are conveyed to the discriminator 21 one by one.

Whenever a bill has been determined authentic by the discriminator 21, it is further conveyed to the temporary storage 22 to be temporarily stored therein. Contrarily, whenever a bill has been determined a rejectable bill which is not adequate for deposition, it is conveyed back to the bill inlet/outlet 20 and the shutter 5 is opened, whereby the bill is returned to the customer.

With respect to the bills not returned but stored in the temporary storage 22, the customer operates the operation display 6 or input device, not shown, to confirm the monetary amount of bills inserted by himself or herself. In turn, the bill depositing and withdrawing machine 4 causes the bills temporarily stored in the temporary storage 22 to be conveyed to the discriminator 21 for determining the denominations or types of the bills. The bills are then conveyed over the conveyance channel 31 to the bill storage 27 to be stored in the bill storing boxes 29 appropriate for the denominations.

By contrast, for example, when the customer inserts his or her cash card or the like into the ATM 1 in order to conduct a transaction such as withdrawal and operates the operation display 6 to touch a transaction item, for example, "withdrawal", on the screen and to input his or her ID number and a desired withdrawn amount, the bill depositing and withdrawing machine 4 determines the number of bills for each denomination and takes out the bills from the bill storing boxes 29 appropriate for the denominations to convey the bills to the discriminator 21 Bills, when having been discriminated by the discriminator 21 as authentic bills, are further conveyed to the bill inlet/outlet 20. Contrarily, bills, when having been discriminated as rejectable bills which are not adequate for withdrawal, are further conveyed to the temporary storage 22 to be temporarily stored therein.

Thereafter, when the bills for withdrawal are collected to the bill inlet/outlet 20, the shutter 5 is opened so that the customer can receive the bills. The bill depositing and withdrawing machine 4, then, conveys the bills temporarily stored in the temporary storage 22 to the repository 23 or 30 to store the bills therein.

Now, reference will be made to FIG. 3 for describing circumstantially the slots 28 in the storage 27. As shown in the figure, the slots 28*a* to 28*e* each have a generally box-like shape that has an opening at its top, a front wall 40, a back wall 41, side walls 42 and a closed bottom 440. The front wall 40 is substantially half as tall as the back wall 41 in the embodiment. Accordingly, the side walls 42 have respective top edges inclining towards the front wall and connect the front wall 40 and back wall 41 with each other. Thus, the slots 28 are of a box-like shape having its front wall 40 shorter than its back wall 41 and having the opening at the top which inclines downward from the back wall 41 to the front wall 40.

The front wall 40 has a generally rectangular shape having an also generally rectangular and oblong hole 46 cut in the vicinity of the upper end of the wall 40. On the rectangular hole 46, a lever 47 is turnably supported. The lever 47 has an oblong plate-like shape, and is for use in supporting an upper small storing box 29Su, when only the upper small storing box 29Su is loaded in the slot 28, to function as a substitute for a lower small storing box 29Sb which would have been loaded.

Figure 4:
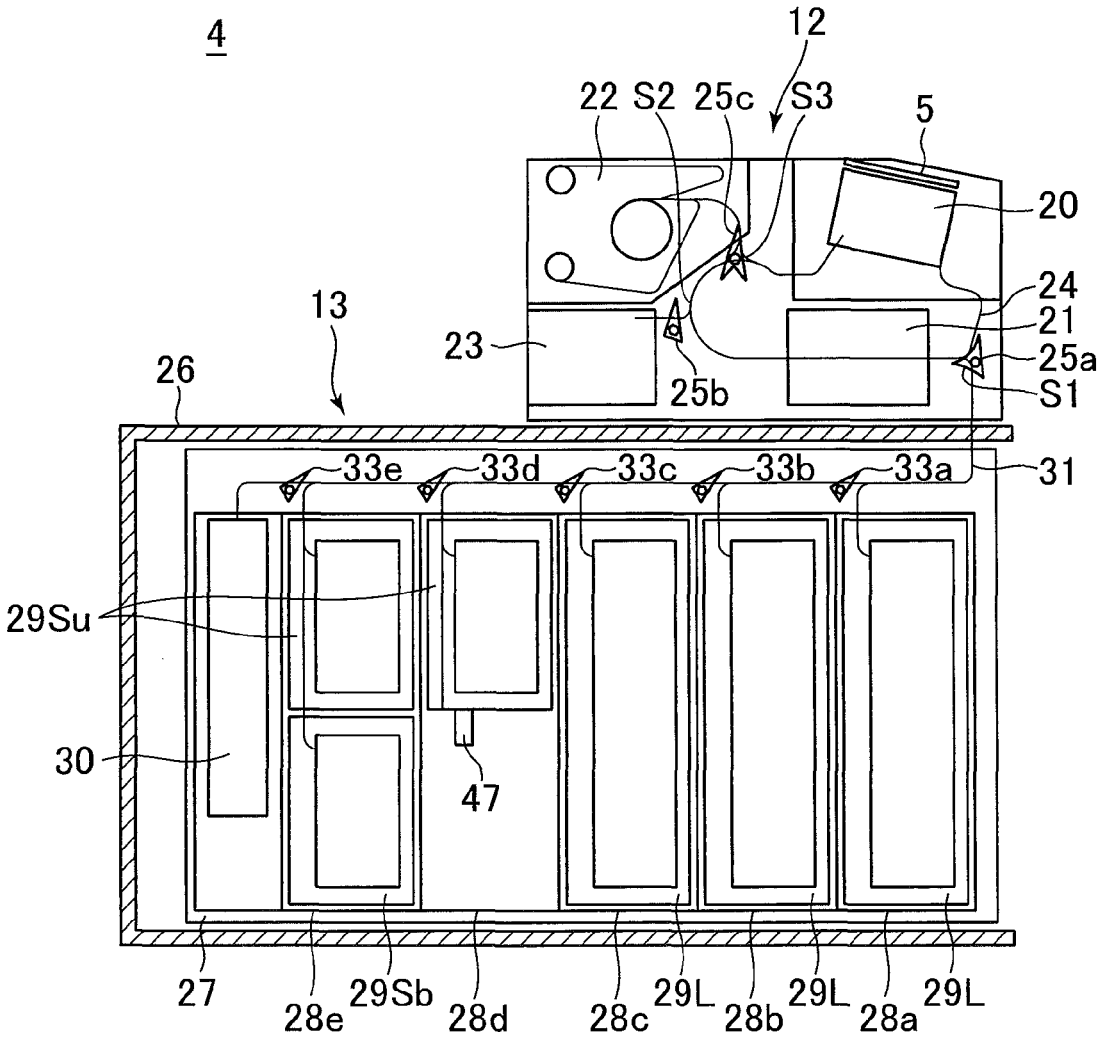
FIG. 4 is a schematic side view, like FIG. 2, showing the bill depositing and withdrawing machine of the embodiment when an upper small storing box is loaded in the slot.

Specifically, the lever 47 is pivotable in the direction of an arrow 442 such that, in the illustrative embodiment, the lever has its one end serving as a rotation axis and projects orthogonally from the front wall 40 to thereby manually rotatable. When the lever 47 is rendered substantially in parallel to the front wall 40, it may be referred to as in the opened state, and when the lever 47 projects from the front wall 40, it may be referred to as in the closed state. Therefore, by arranging the lever 47 in the closed state where the lever 47 is orthogonal to the front wall 40, the lever 47 can contact with the bottom of the upper small storing box 29Su to support and hold the latter. The closed state where the lever 47 can support the upper small storing box 29Su is shown in FIG. 4, for example, where the upper small storing box 29Su in the slot 28*d* is supported by the lever 47.

Figure 8A:
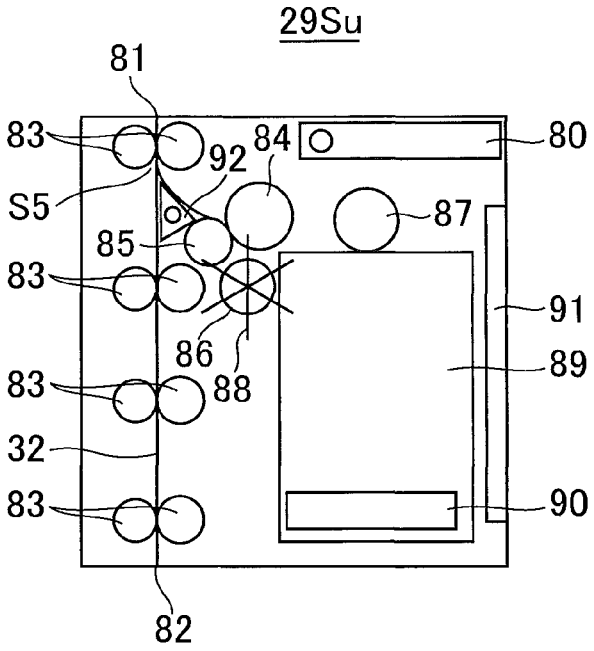
FIGS. 8A, 8B and 8C are schematic side views showing the configuration of a small storing box for upper portion of the embodiment.

The levers 47 may have a function of covering a lower entering and exiting slot 82, FIG. 8A, formed in the upper small storing boxes 29Su in the closed state. It is thereby possible to prevent a bill from wrongly dropping from the lower entering and exiting slot 82 of the upper small storing box 29Su onto the bottom of the slot 28 to be left derelict there. For this function, the lever 47 may be dimensioned so as to sufficiently cover the lower entering and exiting slot 82, and its rotation axis may be adjusted in position such that the lever 47 in the closed state is located immediately below the lower entering and exiting slot 82.

The lever 47 may also have a sensor, not shown, provided at a position that can contact to the bottom of the upper small storing box 29Su, for example. The sensor may be adapted for sensing the bottom of the box 29Su, when becoming in contact with the lever 47, to specifically detect that the lever 47 is in the closed state. For example, the sensor may be of a noncontact type which can contact with the lever 47 in a noncontact manner, or alternatively be of a contact type.

By using the sensor, the upper small storing boxes 29Su may be controlled such that they have the switches 92 thereof inhibited from switching the bill conveyance direction to downward direction, that is, the direction toward the lower entering and exiting slot 82, while the sensor senses the bottom of the upper small storing box 29Su brought into contact with the lever 47. In addition, the upper small storing boxes 29Su may also be controlled such that they have the switch 92 fixed by a link mechanism such as not to switch the bill conveyance direction to downward direction. It is thereby possible to attain the same advantageous effects as in the case where the lever 47 covers the lower entering and exiting slot 82, and also to detect the state where a box 29Su is erroneously loaded without closing the lever 47 and inform the operator accordingly.

In the opened state, the lever 47 is substantially parallel to the front wall 40, so that the lever 47 does not protrude from the front wall 40 toward the back wall 41. Hence, by rendering the lever 47 in its opened state, it is possible to arrange the large storing box 29L or both of the upper and lower small storing boxes 29Su and 29Sb in the slot 28 without causing a physical interference between the lever 47 and the large storing box 29L or the upper and lower small storing boxes 29Su and 29Sb.

Of course, it may be possible to use any suitable mechanism, other than the lever 47, having functions of holding, when only the upper small storing box 29Su is loaded, the upper small storing box 29Su in the upper portion of the slot 28.

Returning to FIG. 3, the back wall 41 has a generally rectangular shape having a groove 48 formed in its inner surface. The groove 48 extends from the top to the middle of the wall 41, and has a bottom 444 where a slot-side connector 49 is arranged. The connector 49 has an electric interface for electrically connecting to the upper small storing box 29Su. In the illustrative embodiment, the connector 49 is located so as to be connectable with a box-side connector 43, described later, of the upper small storing box 29Su when the upper small storing box 29Su is loaded in the upper portion in the slot 28. Also, in the illustrative embodiment, the arrangement of the slot-side connector 49 for the upper small storing box 29Su in the groove 48 formed in the inner wall of the back wall 41 makes it possible to prevent, when the box 29L or 29Sb is loaded in the slot 28, a physical interference from arising between the connector 49 and the large storing box 29L or the lower small storing box 29Sb.

The bottom 440 of the respective slots 28 has the slot-side connector 43, a stage motor 44 and a drive transmitter 45 arranged at respective, predetermined positions. The connector 43 has an electric interface for establishing an electrical connection to the large storing box 29L or lower small storing box 29Sb when loaded in the slot 28. The stage motor 44 serves to generate a driving force for moving a stage 70, FIG. 6A, described later, in the large storing box 29L or the lower small storing box 29Sb. The drive transmitter 45 is adapted for transmitting the driving force generated by the stage motor 44 to the large storing box 29L or the lower small storing box 29Sb.

Well, for comparing the slots 28 according to the invention with conventional slots, reference will be made to FIG. 5 which shows the configuration of conventional slots 210*a* to 210*e*. As shown in the figure, each of the conventional slots 210*a* to 210*e* is directed to a single bill storing box which corresponds to the large storing box 29L in the embodiment of the present invention, and hence does not include components corresponding to the lever 47, the groove 48 in the back wall 41, and the slot-side connector 49 in the slot 28 according to the embodiment.

Next, reference will be made to FIGS. 6A and 6B for describing the large storing boxes 29L. The large storing boxes 29L have functions of accumulating bills therein, and of separating the accumulated bills from each other to be conveyed on the conveyance channel. Note that the large storing boxes 29L may have the same configuration as the conventional bill storing box, and therefore can be loaded in the conventional slots 210*a* to 210*e* shown in FIG. 5. Thus, the bill storage 27 may have the conventional slot/slots 210 as well as, for example, the slots 28 adapted for the two small storing boxes 29S and the conventional slot 210 adapted for the bill storing box 29.

Figure 6A:
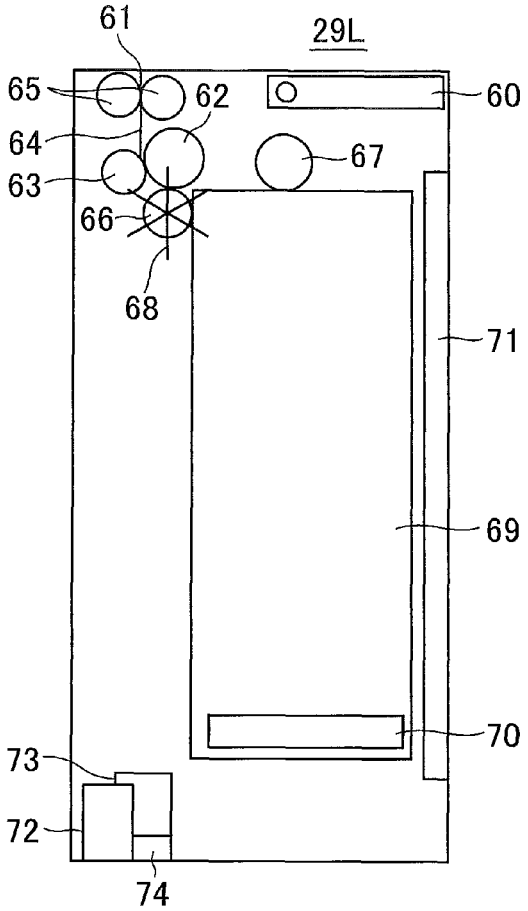
FIGS. 6A and 6B are schematic side views showing the configuration of a large storing box of the embodiment.
Figure 6B:
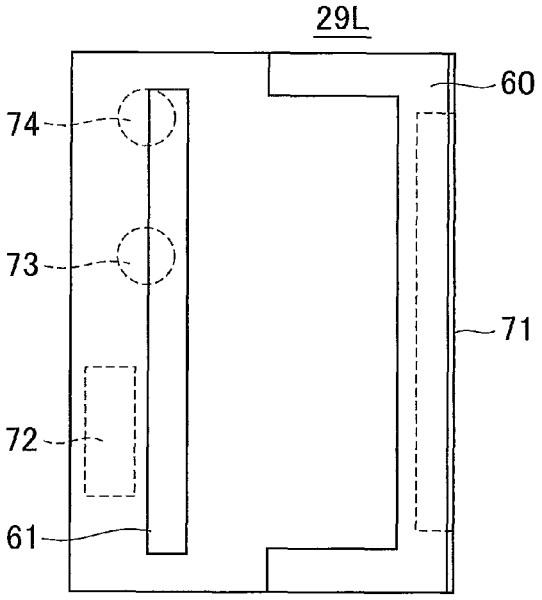

As shown in FIGS. 6A and 6B, the large storing box 29L may be shaped like a tall, or longitudinal, and generally rectangular parallelepiped of substantially the same size as the slot 28, and has a generally C-shaped handle 60 arranged rotatably at the top portion of the box 29 to be used for carrying the large storing box 29L.

In the illustrative embodiment, the handle 60 can be rotated from its one state where it is substantially parallel to the top plate to its other state where it is substantially perpendicular to the top plate, whereby when the operator carries the large storing box 29L, he or she can rotate the handle 60 to its other state in order to grip the handle 60.

The large storing box 29L also has a bill entering and exiting slot 61 arranged in its top plate. In the illustrative embodiment, the bill entering and exiting slot 61 is arranged at a predetermined position, e.g. the opposite side to the handle 60 in the vicinity of the end of the top plate.

As shown in FIG. 6A, in the large storing box 29L, there are arranged in the vicinity of the bill entering and exiting slot 61, a feed roller 62, a pinch roller 63, a conveyance belt 64, conveyance rollers 65, a gate roller 66, a picker roller 67 and a tongue roller 68. The feed roller 62 is arranged in the vicinity of, and below, the bill entering and exiting slot 61. The pinch roller 63 is arranged to the opposite side of the feed roller 62 via the conveyance belt 64. The conveyance belt 64 has a plurality of conveyance rollers 65 arranged cross the conveyance belt 64.

The gate roller 66 is disposed below the feed roller 62 as opposed to the feed roller 62, and the picker roller 67 is disposed in front of the feed roller 62 with a predetermined distance kept therebetween. The tongue roller 68 having tongues is disposed below the feed roller 62. Herein, the feed roller 62, the pinch roller 63, the gate roller 66, the picker roller 67, and the tongue roller 68 may collectively be referred to as separating and accumulating rollers.

The large storing box 29L further has a bill repository 69 arranged in a space in front of the gate roller 66 and below the picker roller 67. The bill repository 69 is a tall and generally rectangular parallelepiped extending to the vicinity of the bottom of the large storing box 29L, and has a plate-like stage 70 provided in the bill repository 69. The stage 70 is for use in stacking bills thereon and movable in the bill repository 69 in the vertical direction, whereby the bill repository 69 can store bills as accumulated on the stage 70.

The large storing box 29L further has a door 71 provided on a wall of the large storing box 29L in front of the bill repository 69. In the illustrative embodiment, the door 71 may usually be locked with a key and can be opened when bills are taken out from the bill repository 69. The large storing box 29L may include some additional components. Specifically in the illustrative embodiment, the storing box 29L has a roller motor, not shown, for generating a motive power for rotating the conveyance rollers 65 and the separating and accumulating rollers 62, 63, 66, 67 and 68, which are provided at predetermined positions in the large storing box 29L.

In the bottom portion of the large storing box 29L, there are provided a box-side connector 72, a concave section 73 and a box-side drive transmitter 74. The box-side connector 72 is a connector arranged at a position opposed to the slot-side connector 43 and adapted connectable to the slot-side connector 43 to function as an electric interface provided on the bottom of the slot 28. The concave section 73 forms an area into which the stage motor 44 is fitted, and is provided at a position opposed to the stage motor 44 provided on the bottom of the slot 28. The box-side drive transmitter 74 is provided at a position opposed to the slot-side drive transmitter 45 provided in the bottom portion of the slot 28 to be connectable to the slot-side drive transmitter 45.

In the illustrative embodiment, the box-side connector 72 is connected to the roller motor so as to feed the roller motor with an electric power and a control signal supplied from the ATM 1. The box-side drive transmitter 74 is mechanically connected to the stage 70 to transmit the motive power of the stage motor 44 to the stage 70.

The large storing box 29L is configured in this way. Thus, the large storing box 29L, when loaded in the slot 28, causes the box-side connector 72 to be connected to the slot-side connector 43 provided on the bottom of the slots 28 and the box-side drive transmitter 74 connected to the slot-side drive transmitter 45 provided in the bottom portion of the slot 28. The large storing box 29L thus receives the electric power and the control signal from the ATM 1 to drive the roller motor to rotate the conveyance rollers 65 and the separating and accumulating rollers 62, 63, 66, 67 and 68, and receives the motive power of the stage motor 44 from the ATM 1 to move the stage 70.

Note that when the box 29L is loaded in the slot 28, the bill entering and exiting slot 61 is rendered connected to the lower conveyance channel 31. Thus, when bills are conveyed on the lower conveyance channel 31 to enter in the boxes 29L through the bill entering and exiting slots 61, they are pinched by the conveyance rollers 65 to be conveyed on the conveyance belt 64, and in turn fed to the nip between the feed roller 62 and the pinch roller 63 to be pinched thereby. The bills are then fed out from the nip between the feed roller 62 and the gate roller 66, and then discharged into the bill repository 69.

The bills are then hit at its rear end and pulled by the tongue of the tongue roller 68 to be piled onto the uppermost bill of the pile of bills accumulated on the stage 70. The stage 70 is lowered in proportion to the number of bills thus piled up so as to ensure space for accumulating bills on the pile on the stage 70 at all times. The above-mentioned operation is repeated, resulting in that bills are increasingly accumulated in the bill repository 69 in the large storing boxes 29L.

Contrarily, when bills are sent out from the large storing box 29L, the stage 70 is raised until the uppermost bill accumulated on the stage 70 abuts to be pressed by the picker roller 67. When the uppermost bill is pressed by the picker roller 67, the picker roller 67 of the box 29 rotates.

At this time, the gate roller 66 stops and only the feed roller 62 rotates whereby the uppermost bill is separated from the remaining bills to be sent to the nip between the feed roller 62 and the gate roller 66. The feed roller 62 continues to rotate to send the bill further to the nip between the feed roller 62 and the pinch roller 63, and from that nip the bill is conveyed to the bill entering and exiting slot 61 by the conveyance rollers 65, from which the bill is sent to the lower conveyance channel 31. The above-mentioned operation is repeated, resulting in that the accumulated bills in the bill repository 69 are extracted one by one.

Figure 7A:
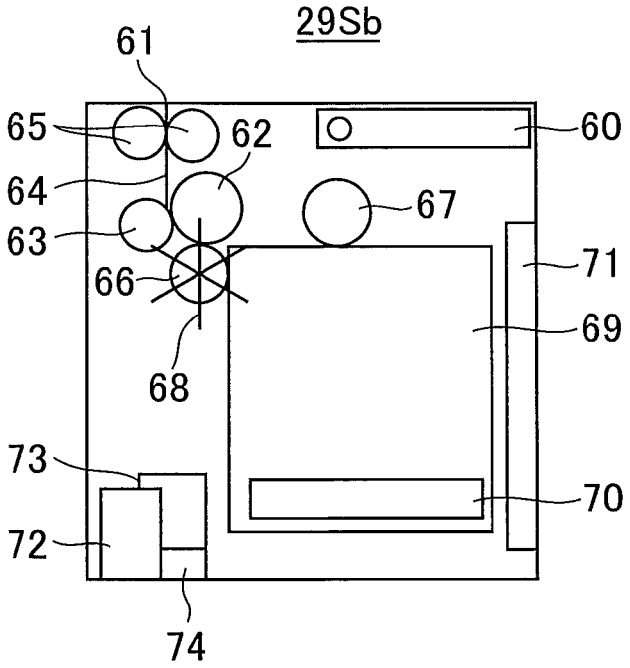
FIGS. 7A, 7B and 7C are schematic side views showing the configuration of a small storing box for lower portion of the embodiment.
Figure 7B:
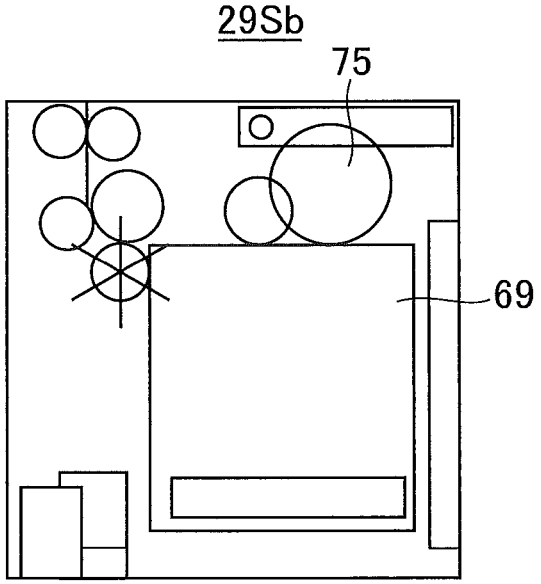
Figure 7C:
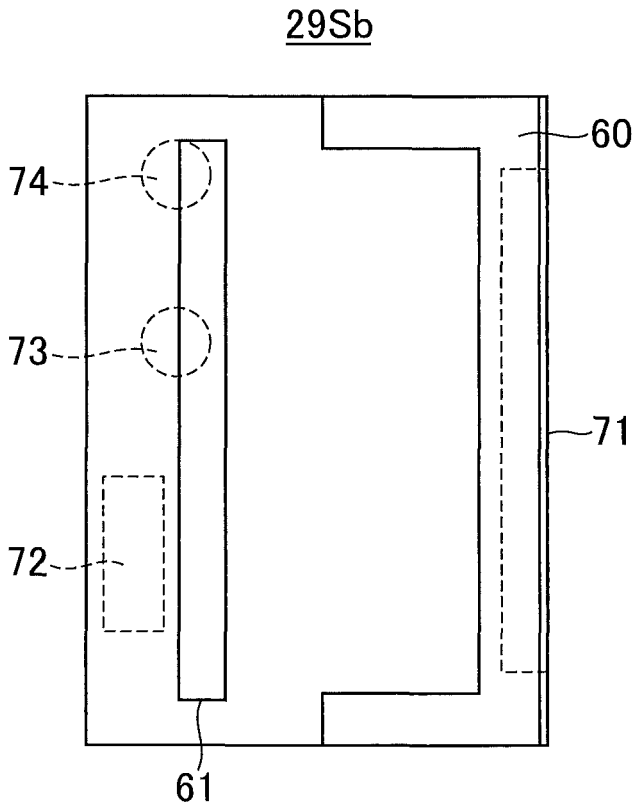

Now, reference will be made to FIGS. 7 and 8 for describing the lower small storing box 29Sb and upper small storing box 29Su, respectively. The lower small storing boxes 29Sb have functions of accumulating sent bills therein, and of separating the accumulated bills one by one to be conveyed on the conveyance channel. Hence, as shown in FIGS. 7A and 7C, the lower small storing boxes 29Sb may have the similar parts and components to those of the large storing boxes 29L, but may be substantially half as tall as the large storing boxes 29L. Accordingly, the lower small storing boxes 29Sb have respective bill repositories 690 having a half vertical length, or height, of that of the bill repositories 69 of the large storing boxes 29L. The bill repositories 690 may be the same as the bill repositories 69 in the large storing boxes 29L except for the height thereof.

Note that the lower small storing boxes 29Sb may additionally include other parts or components than the large storing boxes 29L. For example, in the illustrative embodiment, as shown in FIG. 7B, the lower small storing box 29Sb may have a roller motor 75 arranged between the bill repository 690 and the top plate 700. The roller motor 75 is adapted for generating a motive power for rotating the conveyance rollers 65, and separating and accumulating rollers 62, 63, 66, 67 and 68.

It is also noted that the door 71 in the lower small storing boxes 29Sb may be locked with the same key as, or a different key than, the door 71 of the large storing boxes 29L. When the door 71 of the lower small storing boxes 29Sb is adapted to be locked with such a different key, the security will be enhanced.

With reference to FIG. 8A, the upper small storing box 29Su has functions of accumulating sent bills, and of separating the accumulated bills one by one to be conveyed on the conveyance channel. Hence, as shown in FIGS. 8A and 8C, the upper small storing boxes 29Su may have the similar parts and components to those of the large storing boxes 29L, but may be, as with the lower small storing boxes 29Sb, substantially half in height, or vertical length, as much as the large storing boxes 29L. Accordingly, the upper small storing boxes 29Sb have respective bill repositories 89 having a half vertical length of that of the bill repositories 69 of the large storing boxes 29L.

As shown in FIG. 8C, the upper small storing box 29Su has a generally C-shaped handle 80 arranged rotatably at its top portion, like the handle 60 in the large storing boxes 29L, and a bill entering and exiting slot 81 arranged in the top plate of the box 29Su. In the illustrative embodiment, the bill entering and exiting slot 81 is arranged at a position corresponding to the bill entering and exiting slot 61 in the large storing box 29L, specifically at a predetermined position near the rear end of the top plate.

The upper small storing box 29Su also has a bill entering and exiting slot 82 arranged, as shown in FIG. 8A, in the bottom plate of the box 29Su. The bill entering and exiting slot 82 is arranged at a position corresponding to the bill entering and exiting slot 81 in the top plate, specifically at a predetermined position near the rear end of the bottom plate. Therefore, when the upper small storing box 29Su is stacked on the lower small storing box 29Sb, the lower entering and exiting slot 82 faces to the bill entering and exiting slot 61 in the top plate of the lower small storing boxes 29Sb. The bill entering and exiting slots 81 and 82 may be referred to as upper and lower entering and exiting slots, respectively.

Between the upper and lower entering and exiting slots 81 and 82, the conveyance channel 32 is arranged as shown in FIG. 8A. The conveyance channel 32 is linear to connect the upper and lower entering and exiting slots 81 and 82 to each other, and may have a plurality of conveyance rollers 83, a feed roller 84, a pinch roller 85, a gate roller 86, a picker roller 87, a tongue roller 88 and a bifurcation S5 disposed as depicted.

The conveyance rollers 83 are arranged on the both sides of the conveyance channel 32 such that they are disposed across the conveyance channel 32. The feed roller 84 is disposed at a predetermined position near the upper entering and exiting slot 81 and closer to the center than the in-box conveyance channel 32, that is, diagonally below the upper entering and exiting slot 81 in front. The pinch roller 85 is disposed in the rear of the feed roller 84 such that the roller 85 faces to the feed roller 84. The gate roller 86 is disposed below the feed roller 84 such that the roller 86 also faces to the feed roller 84. The picker roller 87 is disposed in front of the feed roller 84 with a predetermined distance kept therebetween.

The tongue roller 88, having a tongue, is disposed below the feed roller 84. The feed roller 84, pinch roller 85, gate roller 86, picker roller 87 and tongue roller 88 may collectively be referred to as separating and accumulating rollers.

Figure 8B:
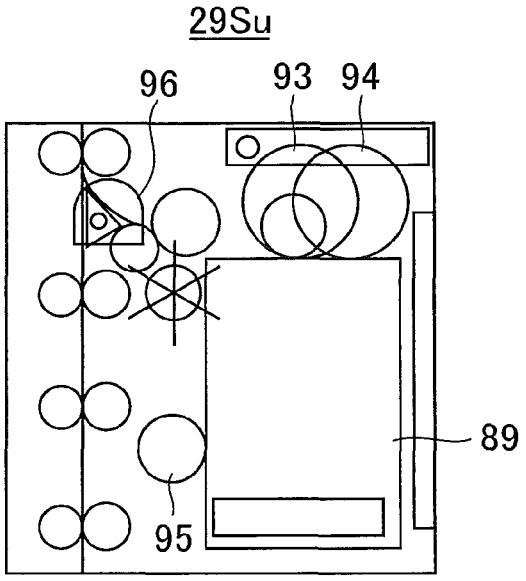
Figure 8C:
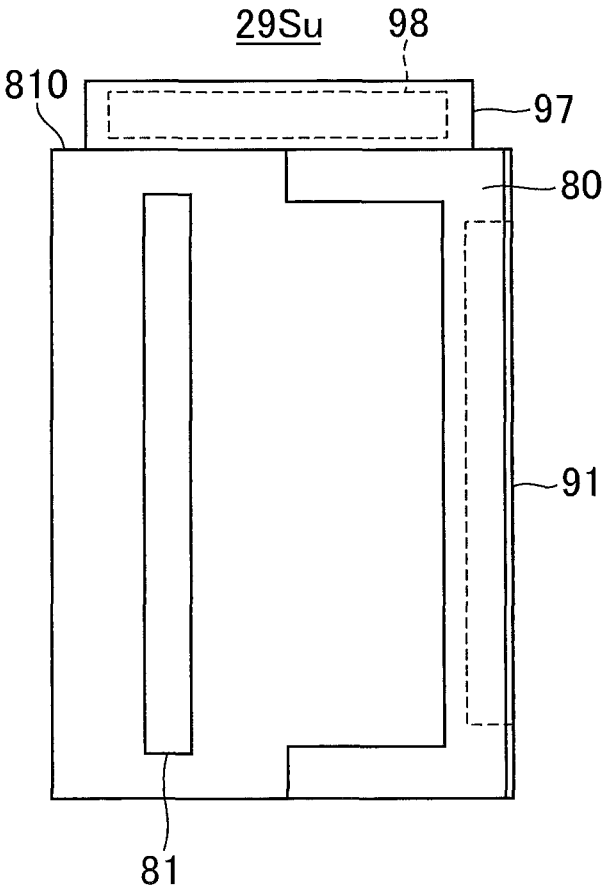

For those rollers, the upper small storing boxes 29Su may have, for example, roller motors 93 and 94 arranged, as shown in FIG. 8B, between the bill repository 89 and the top plate thereof. The roller motor 93 is provided for generating motive power to rotate the conveyance rollers 83. The roller motor 94 is arranged for generating motive power for rotating the separating and accumulating rollers 84 to 88.

Return to FIG. 8A, near the upper entering and exiting slot 81, the bifurcation S5 is arranged for separating the conveyance channel 32 into one conveyance channel extending to the lower entering and exiting slot 82 and another conveyance channel extending obliquely downward to the feed roller 84 and pinch roller 85. The bifurcation S5 has a switch 92 arranged for switching a bill conveyance direction between the upward direction, toward the upper entering and exiting slot 81, the downward direction, toward the lower entering and exiting slot 82, and the frontward direction, toward the bill repository 89.

The bill repository 89 is a longitudinal, i.e. tall, and generally rectangular parallelepiped extending to the vicinity of the lower end of the upper small storing box 29Su. In the illustrative embodiment, the bill repository 89 is arranged near the gate roller 86 and below the picker roller 87.

Note that, in the illustrative embodiment, the upper small storing boxes 29Su have the conveyance channel 32 and thus have a smaller horizontal space for the bill repository 89 than the lower small storing boxes 29Sb. Therefore, the bill repositories 89 in the upper small storing boxes 29Su may be smaller in width than the bill repositories 690 in the lower small storing boxes 29Sb. Of course, the bill repositories 89 may have the same size as the bill repositories 69 in the lower small storing boxes 29Sb. In this case, the upper small storing boxes 29Su and the lower small storing boxes 29Sb may have the same storage capacity, and thus the boxes having the same capacity can be loaded and stacked vertically one above the other in the slots 28.

The upper small storing boxes 29Su also have a stage 90 and a door 91 provided. The stage 90 may be the same as the stage 70 in the bill repository 69 and is adapted for stacking bills thereon. The door 91 may be the same as the door 71 in the large storing boxes 29L, and is provided on a wall of the upper small storing boxes 29Su in front of the bill repository 89. Note that the door 91 may be locked with the same key as, or a different key than, the doors 71 of the boxes 29L and 29Sb, or the doors 71 of the boxes 29L and 29Sb. When the door 91 is adapted to be locked with such a different key, the security will further be enhanced with those boxes 29L, 29Su and 29Sb handled independently of each other.

The upper small storing boxes 29Su may additionally have any other suitable parts or components. For example, they may have a stage motor 95 and a swing selector 96 as shown in FIG. 8B. The stage motor 95 is arranged, in the illustrative embodiment, between the bill repository 89 and the conveyance channel 32 for generating the motive power for driving the stage 90. The swing selector 96 is arranged in the vicinity of the bifurcation S5 for operating the switch 92.

Figure 3:
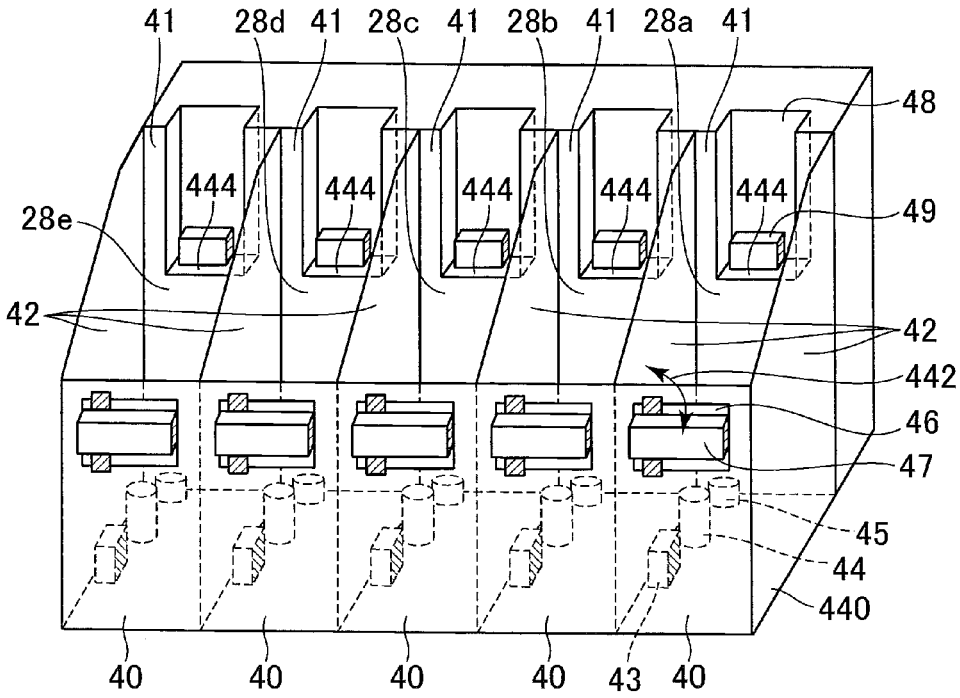
FIG. 3 is a schematic perspective view showing the configuration of slots in a bill storage of the embodiment.

Also, as shown in FIG. 8C, the upper small storing box 29Su has a protrusion 97 formed at the side wall 810 that will face the wall 41, FIG. 3, in the slot 28 when the upper small storing box 29Su is loaded in the slot 28. The protrusion 97 has a shape fitting into the groove 48 formed in the back wall 41, and specifically has a generally rectangular parallelepiped having a top plate on which a connector 98 is arranged. The connector 98 is a box-side connector for connecting to the connector 49 of slot-side. In the illustrative embodiment, the connector 98 is also connected to the roller motors 93 and 94, stage motor 95 and swing selector 96 so as to transmit to them an electric power and a control signal supplied from the ATM 1.

The upper small storing boxes 29Su are configured in this way. Thus, the upper small storing box 29Su, when loaded in the slot 28, causes the protrusion 97 to fit into the groove 48 in the slot 28, and the connector 98 to be connected to the slot-side connector 49 provided in the groove 48 in the slot 28 and the upper bill entering and exiting slot 81 to be connected to the conveyance channel 31. The upper small storing box 29Su thus receives the electric power and the control signal from the ATM 1 to drive the roller motors 93 and 94, stage motor 95 and swing selector 96 to rotate the conveyance rollers 83 and the separating and accumulating rollers 84 to 88 to thereby move the stage 90 and operate the switch 92.

Specifically, when the upper small storing box 29Su accumulates bills, the switch 92 of the box 29Su switches the bill conveyance direction to the direction toward the bill repository 89. Thus, bills, when conveyed on the lower conveyance channel 32 via the upper entering and exiting slot 81, are conveyed toward the repository 89 by the feed roller 84, pinch roller 85, gate roller 86 and tongue roller 88 to be accumulated on the stage 90.

On the other hand, when the accumulated bills are sent out from the upper small storing box 29Su, the switch 92 of the box 29Su switches the bill conveyance direction to the direction toward the upper entering and exiting slot 81 and uses the picker roller 87, feed roller 84, pinch roller 85 and gate roller 86 to extract the bills one by one, which will be conveyed to the upper entering and exiting slot 81 and fed out from the slot 81.

In this way, the upper small storing boxes 29Su perform bill accumulation and feeding. The upper small storing boxes 29Su also work as a conveyance channel between the conveyance channel 31 and the lower small storing boxes 29Sb as shown in FIG. 9, that is to say, the upper small storing boxes 29Su have a function as a conveyance channel as well as a function of accumulating and feeding bills.

Figure 9:
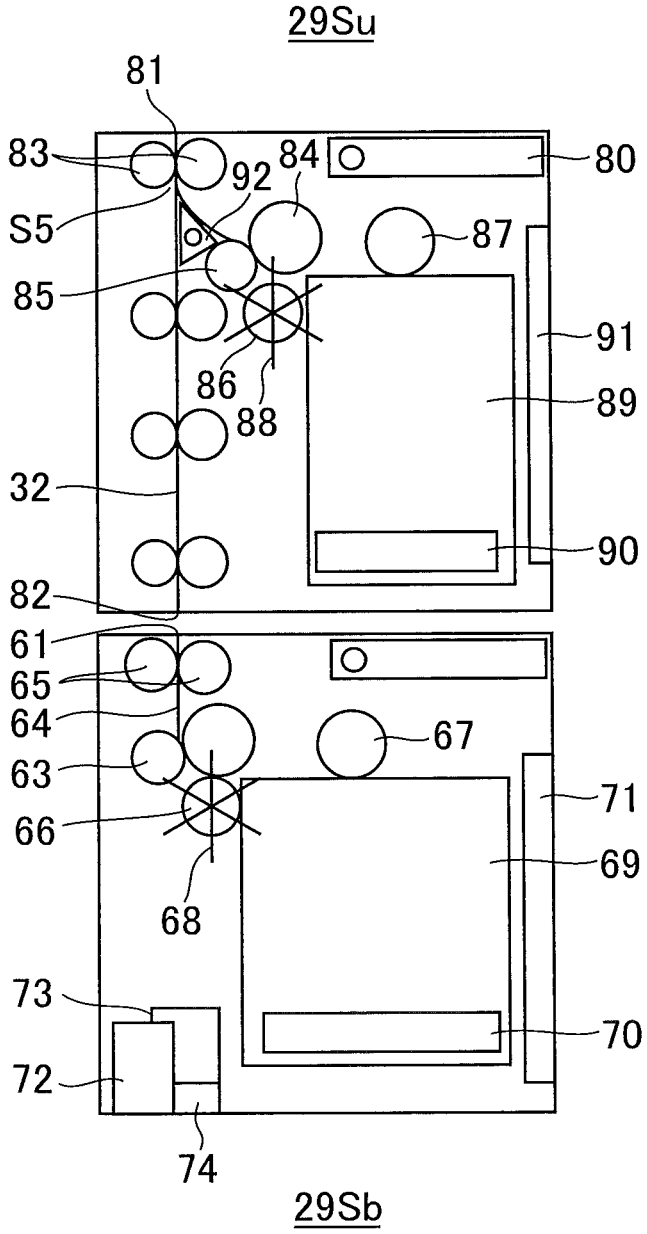
FIG. 9 is schematic side view showing the small storing box for upper portion and the small storing box for lower portion stacked on the former.

Specifically, when the upper small storing box 29Su stacked on the lower small storing box 29Sb, as shown in FIG. 9, and bills are to be transferred to the lower small storing box 29Sb, the switch 92 of the upper box 29 Su changes the bill conveyance direction to the direction toward the lower entering and exiting slot 82.

Thus, when bills are conveyed on the conveyance channel 31 to be entered into the upper small storing box 29Su from the upper entering and exiting slot 81, the conveyance rollers 83 of the upper small storing box 29Su conveys the bills over the conveyance channel 32 to the lower entering and exiting slot 82 to eject them from the slot 82. The bills are thereafter drawn into the entering and exiting slot 61 in the lower small storing box 29Sb, which is arranged just below, and adjacent to, the lower entering and exiting slot 82.

Contrarily, when the upper small storing box 29Su conveys bills to the conveyance channel 31, the switch 92 of the box 29Su changes the bill conveyance direction to the direction toward the upper entering and exiting slot 81. Thus, when the bills are discharged from the bill entering and exiting slot 61 in the lower small storing box 29Sb and enter into the upper small storing box 29Su through the bill entering and exiting slot 82, the conveyance rollers 83 of the upper small storing box 29Su convey the bills on the conveyance channel 32 to the lower entering and exiting slot 81 to eject them from the slot 81. The bills are thereafter passed to the conveyance channel 31 to be conveyed on the latter.

Figure 10:
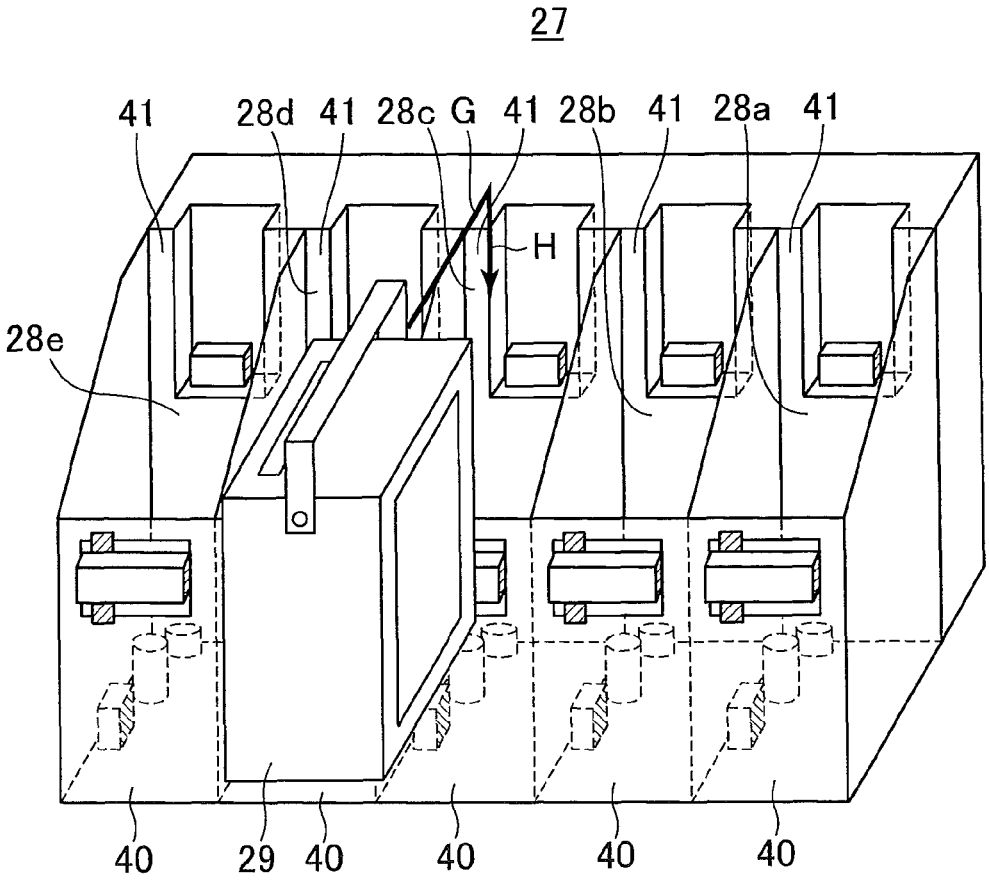
FIG. 10 is a schematic perspective view, like FIG. 3, useful for understanding how to load of the bill storing box.

Those boxes 29L, 29Su and 29Sb can be easily loaded in the slots 28 as shown in FIG. 10, which shows the state where one of the boxes 29L, 29Su and 29Sb is going to be loaded in one slot 28. Specifically, at the start, the operator may raise the bill storing box 29 above the front wall 40, rather than raising it immediately above the slot 28, and then lowered. Next, he or she moves the bill storing box 29 horizontally from the front wall 40 to the back wall 41 as indicated by the horizontal arm G of an arrow H in the figure. During the movement, the bill storing box 29 may be positioned between the side walls 42 of the slot 28. Then, upon the bill storing box 29 abutting the back wall 41, the box 29 may be lowered as indicated by the arrow H in FIG. 10 and just loaded in the slot 28.

The operator is not required to raise the bill storing boxes 29, which may each be rather heavy, as a few to tens of kilograms, immediately above the slots 28, that is, above the back wall 41. The loading of the boxes 29 can thus be simplified. It is to be noted that, when the bill storing box 29 has simply been brought into a position between the side walls 42, the operator is merely required to move the box 29 horizontally until it comes into contact with the back wall 41. Thus, the boxes 29 can be positioned more easily than the conventional way where the bill storing box 29 would be lowered from immediately above the slot 28 to be loaded in the slot 28.

The bill storing boxes 29 can be taken out through a procedure reverse to the loading procedure described above. Note that the upper small storing boxes 29Su are separated from the lower small storing boxes 29Sb, and hence these boxes can be individually mounted to and detached from the slots 28.

The bill depositing and withdrawing machine 4 with the above-mentioned configuration can be used compatibly with the conventional bill depositing and withdrawing machines in a home market, such as Japanese domestic market. In addition, the machine 4 can be used in other counties than Japan where bills of more denominations than Japan circulate, without changing the number and size of the slots 28.

Figure 11:
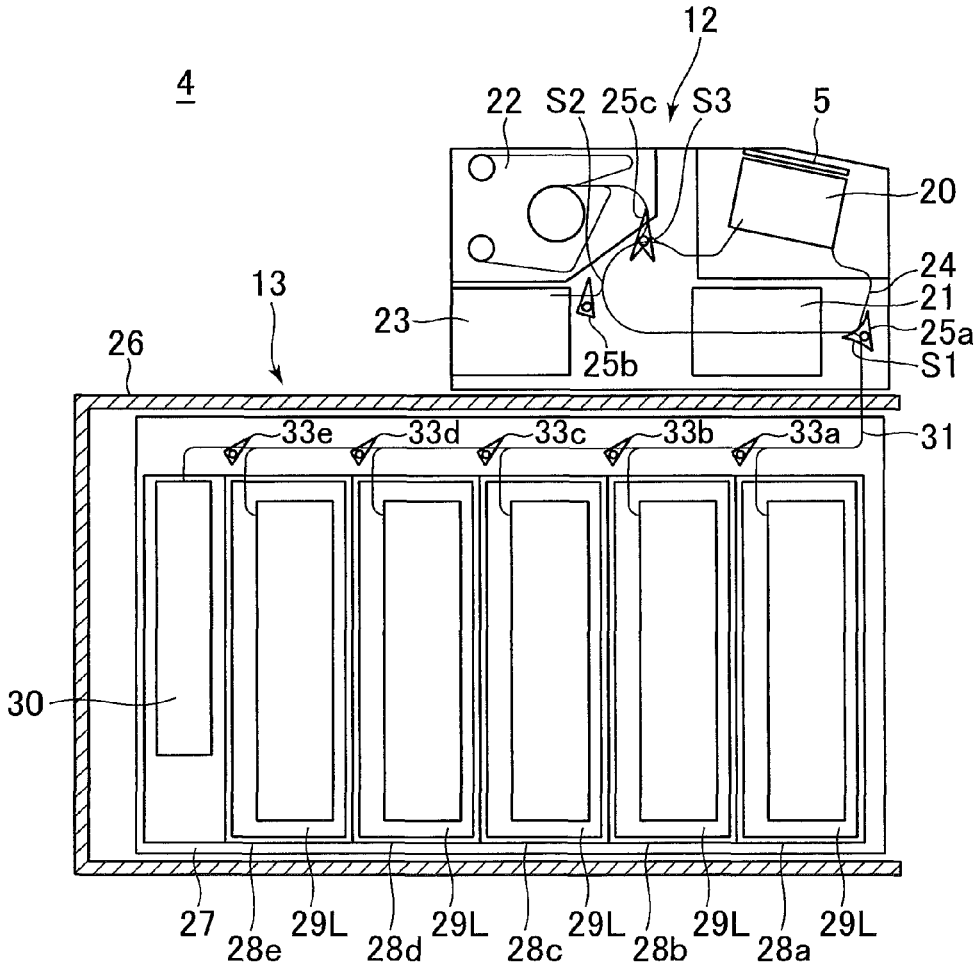
FIG. 11 is a schematic side view showing the large storing boxes exclusively loaded in the slot.

For example, as shown in FIG. 11, for the Japanese domestic market, the bill depositing and withdrawing machine 4 may be designed to have five large storing boxes 29L loaded in the respective, five slots 28 so as to handle the five denominations or kinds of bills, whereby the same operation as conventional can be achieved. On the contrary, for example, for use in foreign counties in which bills of more denominations than Japan circulate, as shown in FIGS. 2 and 4, the bill depositing and withdrawing machine 4 may have three large storing boxes 29L, two upper small storing boxes 29Su, and one or two lower small storing box or boxes 29Sb loaded in the respective slots according to the denominations of the counties. It is therefore possible to handle six or more denominations of bills without changing the number and size of the slots 28 to use the same machine 4 as used in Japan in such foreign countries.

The bill depositing and withdrawing machine 4 can also include a more number of bill storing boxes 29 than the conventional machines, whereby it is also possible to determine the level of damaged bills to sort and store damaged bills according to the damage level. For example, the bill depositing and withdrawing machine 4 has the discriminator 21 determining the bill damage level to store bills of the same damage level in an appropriate bill storing box 29.

Further, as described with reference to FIGS. 2 and 4, the storage boxes 29 to be loaded into the slots 28 may be appropriately selected from among the large storing boxes 29L and the small storing boxes 29S. For example, the large and small storing boxes 29L and 29S may be loaded such that the denominations of bills circulating more frequently are to be stored in the large storing boxes 29L while the denominations of bills circulating less frequently are to be stored into the small storing boxes 29S. The bill depositing and withdrawing machine 4 can thus attain such a variety of using modes.

Further, since the upper small storing boxes 29Su and lower small storing boxes 29Sb can be individually attached to and detached from the slots 28, it is possible to unload any boxes 29 for maintenance.

For example, when the upper and lower small storing boxes 29Su and 29Sb are loaded in the slots 28 and an upper small storing box 29Su is required for maintenance, it is possible to detach only that upper small storing box 29Su from the slot 28 for maintenance. Contrarily, if a lower small storing box 29Sb to be serviced has to be unloaded, then the operator may temporarily unload the upper small storing box 29Su stacked on the lower storing box 29Sb and then return the upper box 29Su to the slot 28 after having dealt with the lower box 29Sb. It is thus possible to detach only the lower small storing box 29Sb from the slot 28 for maintenance. During the servicing of the box 29Sb in question, that upper small storing box 29Su can work independently of the absence of the lower small storing box 29Sb thus removed. Accordingly, the bill depositing and withdrawing machine 4 can handle various bills without impairing maintainability.

Figure 5:
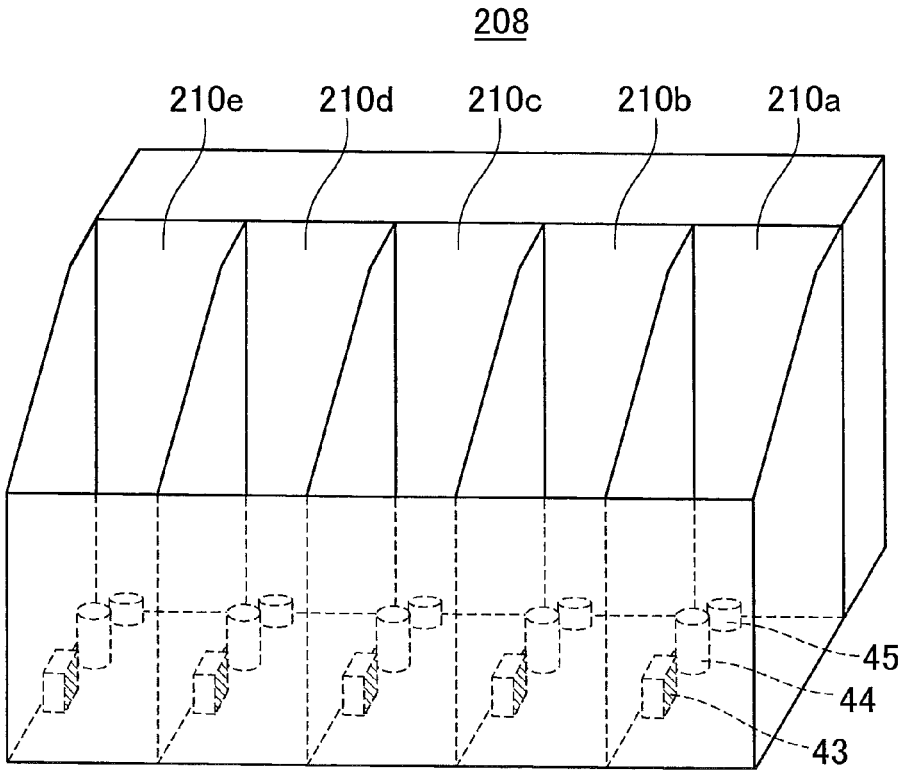
FIG. 5 PRIOR ART
FIG. 5 is a schematic view showing the configuration of slots in a conventional bill store.

Of course, the upper and lower small storing boxes 29Su and 29Sb may be loaded in the conventional slots 210*a* to 210*e*, FIG. 5. In this case, since the conventional slots 210*a* to 210*e* have no groove corresponding to the groove 48 and hence have no connector corresponding to the slot-side connector 49 for connecting to the box-side connector 98, the upper or lower small storing box 29Su or 29Sb needs to have the slot-side connector 49. For example, the slot-side connector 49 may be provided at the top plate of the lower small storing box 29Sb, and the upper small storing box 29Su may have the box-side connector 98 provided at the bottom of the box 29Su without protrusion corresponding to the protrusion 97 whereby it is possible to have the slot-side connector 49 connecting to the slot-side connector 43 arranged at the bottom in the respective slots 210*a* to 210*e* when the lower small storing box 29Sb is laded in the slot 210, and possible to have the box-side connector 98 connecting to the slot-side connector 49 arranged at the top in the lower small storing box 29Sb when the upper small storing box 29Su is stacked on the lower small storing box 29Sb. In this way, although the lower small storing box 29Sb is always necessary for connecting the slot-side connector 49 to the box-side connector 98, the upper and lower small storing boxes 29Su and 29Sb can be loaded in the conventional slots 210*a* to 210*e* having no groove 48, and can avoid the necessity for providing the groove 48 in respective slots 28*a* to 28*d*, FIG. 3, according to the embodiment.

Well, reference will be made to FIGS. 12A, 12B and 12C to describe an alternative embodiment of the small storing box. The upper small storing box 100 is dedicated to accumulation and has no function of discharging. The box 100 may also be of substantially the same size as, and can be exchanged with, the upper small storing box 29Su. Further, as shown in the figure, the box 100 has feed rollers 101 and 121, gate rollers 102 and 122, tongue rollers 103 and 123, stages 105 and 125, a plurality of bill repositories, in the alternative embodiment, and two bill repositories 104 and 124.

The feed rollers 101 and 121 are arranged at respective predetermined positions. In the alternative embodiment, those feed rollers 101 and 121 are disposed near the conveyance channel 32, below which the gate rollers 102 and 122 are arranged to face the feed rollers 101 and 121, respectively. The tongue rollers 103 and 123, having a tongue, are also disposed below the feed rollers 101 and 121 to face them, respectively. The feed rollers 101 and 121, gate rollers 102 and 122, and tongue rollers 103 and 123 may be referred to as accumulating rollers.

The bill repositories 104 and 124 are arranged in space below the feed rollers 101 and 121 in front of the gate rollers 102 and 122, respectively. The bill repositories 104 and 124 are of a generally rectangular parallelepiped and have the stage 105 and 125, respectively. In the alternative embodiment, each of the bill repositories 104 and 124 is inclined downward from its rear end toward its front end, and accordingly the corresponding stage 105 or 125 is also inclined in parallel with the repository 104 or 124. Therefore, when bills are accumulated in the respective repositories 104 and 124, they will be oriented with their edges brought into contact with the side wall of the repository 104 or 124 and hence aligned with each other.

In short, the box 100 is dedicated to accumulation of bills, and hence the repositories 104 and 124 are also dedicated to accumulation. The stages 105 and 125 are fixed to respective springs, not shown, so as to move downward in response to the weight of accumulated bills.

Figure 12A:
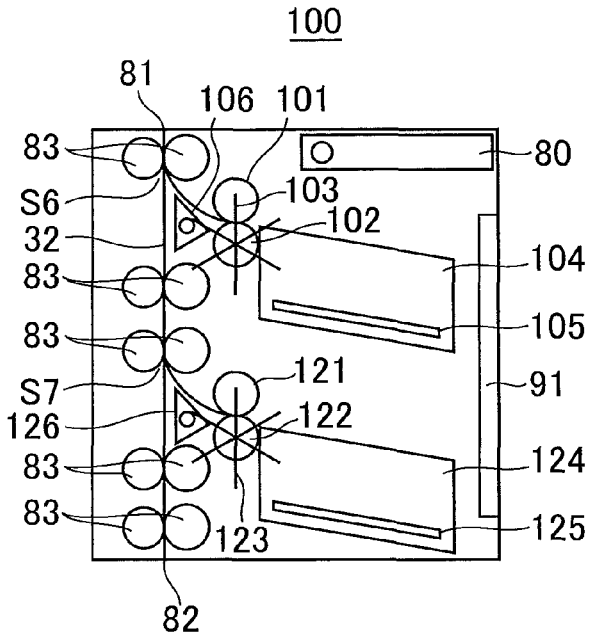
FIGS. 12A, 12B and 12C are schematic side views, like FIGS. 7A, 7B and 7C, showing the configuration of a small storing box for upper portion in accordance with an alternative embodiment of the invention.
Figure 12B:
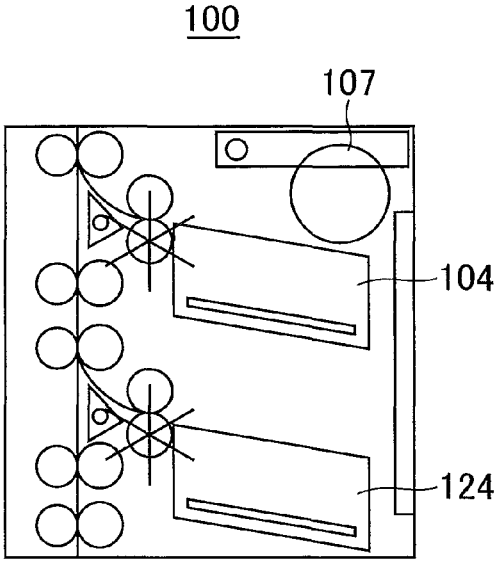
Figure 12C:
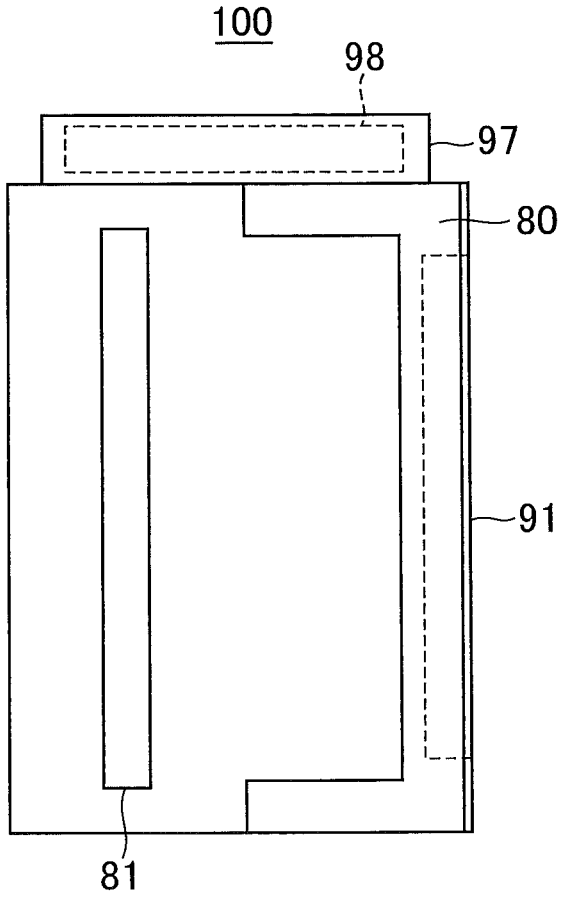

As depicted in FIGS. 12A, 12B and 12C, the conveyance channel 32 has two bifurcations S6 and S7 arranged therein, each of which is adapted to separate the conveyance channel 32 into one conveyance channel extending obliquely downward to the feed roller 101 or 121 and gate roller 102 or 122, and another conveyance channel extending to the lower entering and exiting slot 82 or the bifurcation S7. The conveyance channel 32 has switches 106 and 126 arranged for switching its bill conveyance direction between the upward direction toward the upper entering and exiting slot 81, the downward direction toward the lower entering and exiting slot 82 or the bifurcation S7, and the frontward direction toward the bill repository 104 or 124.

The switch 106 as well as the feed roller 101, the gate roller 102 and the tongue roller 103 form a sorting mechanism, which may be referred to as upper sorting mechanism. Similarly, the switch 126 as well as the feed roller 121, the gate roller 122 and the tongue roller 123 form a sorting mechanism, which may be referred to as lower sorting mechanism.

The small storing box 100 may additionally include any other suitable parts or components. For example, in the alternative embodiment, as shown in FIG. 12B, the box 100 has a roller motor 107 arranged between the bill repository 104 and the top plate of the box 100. The roller motor 107 is adapted for generating motive power rotating the conveyance rollers 83 and the accumulating rollers 101, 121, 102, 122, 103 and 123.

The upper small storing box 100 is so configured that, when the upper small storing box 100 receives from the ATM 1 the electric power and the control signal for storing the bills in the repository 104, the switch 106 of the upper small storing box 100 switches the bill conveyance direction to the direction toward the bill repository 104. Thus, bills, when conveyed on the lower conveyance channel 32 via the upper entering and exiting slot 81, are directed to the repository 104 by the upper sorting mechanism to be accumulated on the stage 105 in the repository 104.

Contrarily, when the upper small storing box 100 receives the control signal for storing the bills in the repository 124, the switch 106 of the upper small storing box 100 switches the bill conveyance direction to the downward direction toward the bifurcation S7, and the switch 126 switches the bill conveyance direction to the lateral direction toward the repository 124. Thus, bills, when conveyed on the lower conveyance channel 32 via the upper entering and exiting slot 81, are directed to the repository 124 by the lower sorting mechanism to be accumulated on the stage 125 in the repository 124.

In this way, the upper small storing box 100 can sort bills by the upper and lower sorting mechanisms, whereby it is possible to store two denominations of bills into one upper small storing box 100 and hence to handle more types of bills in its entirety.

Figure 13:
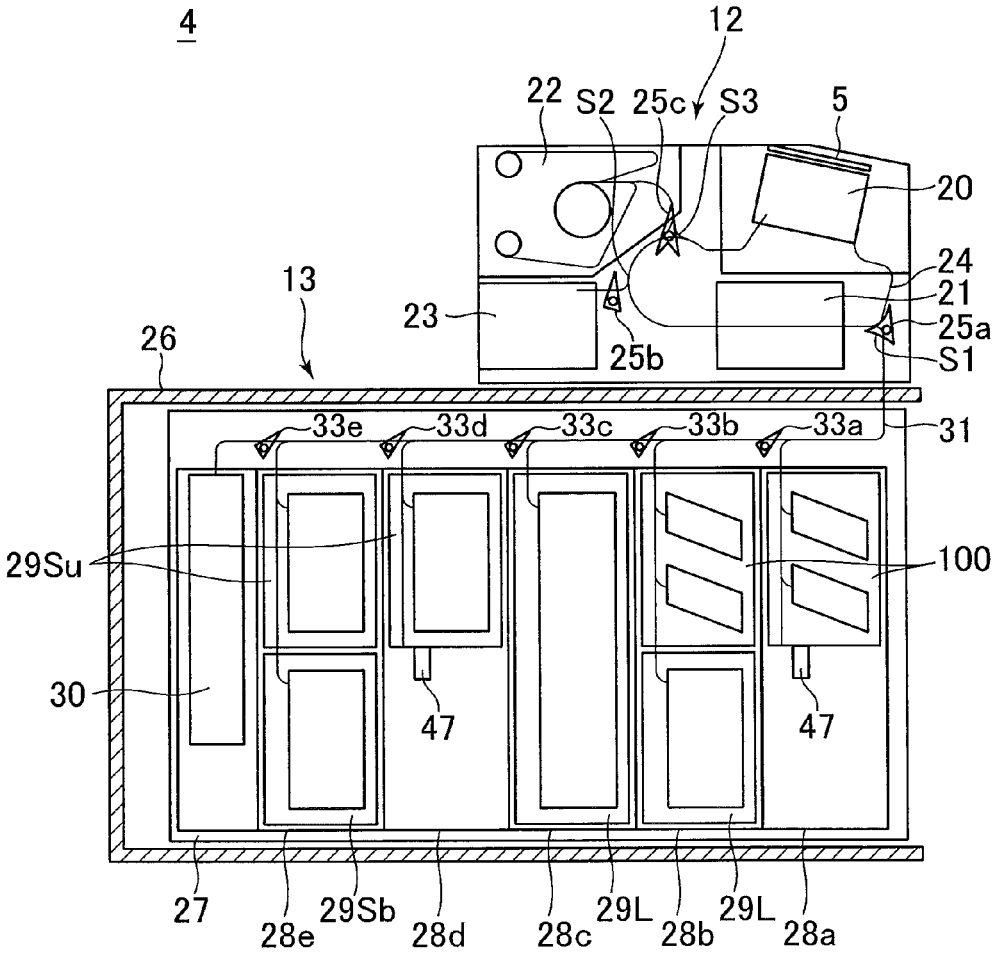
FIG. 13 is a schematic side view, like FIG. 2, showing a combination of the bill storing boxes in the alternative embodiment.
Figure 14:
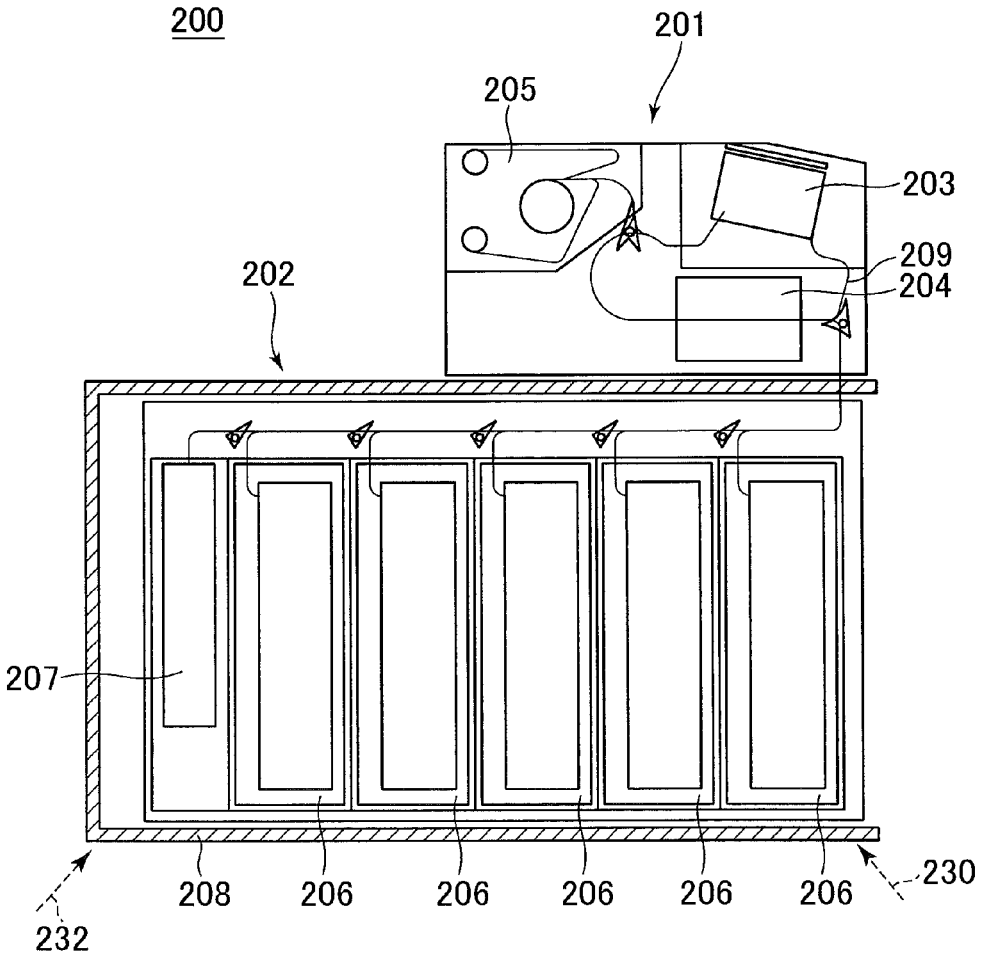
FIG. 14 PRIOR ART
FIG. 14 is a schematic side view showing the configuration of a conventional bill depositing and withdrawing machine.
Figure 15:
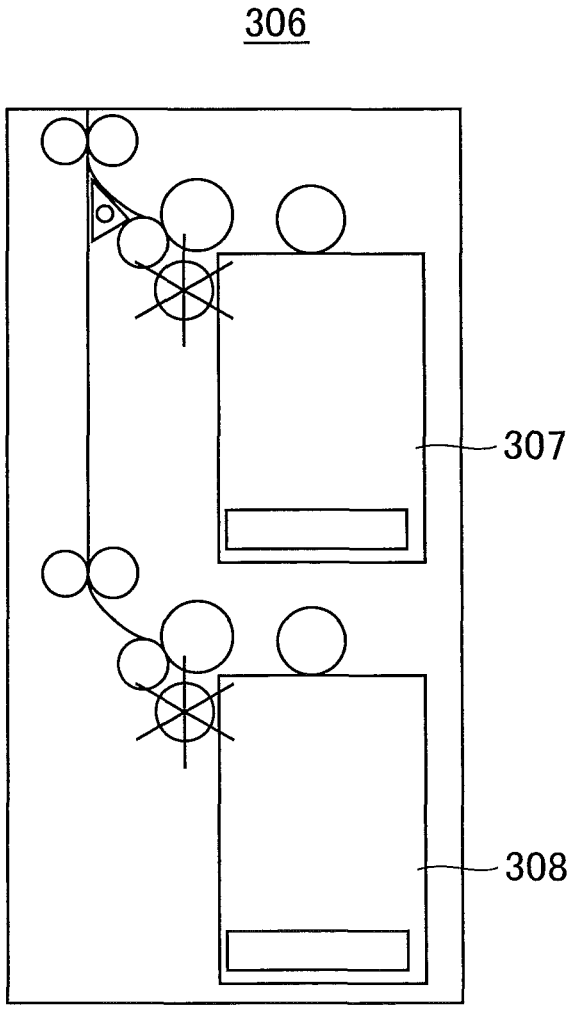
FIG. 15 PRIOR ART
FIG. 15 is a schematic side view showing the configuration of a conventional bill storing box having two repositories.

Also, as described above, the upper small storing boxes 100 have the same size as, and are compatible with, the upper small storing boxes 29Su, whereby, as shown in FIG. 13, it is possible to use the upper small storing boxes 100 and 29Su simultaneously in the bill depositing and withdrawing machine 4 and to handle increased denominations of bills.

Figure 16:
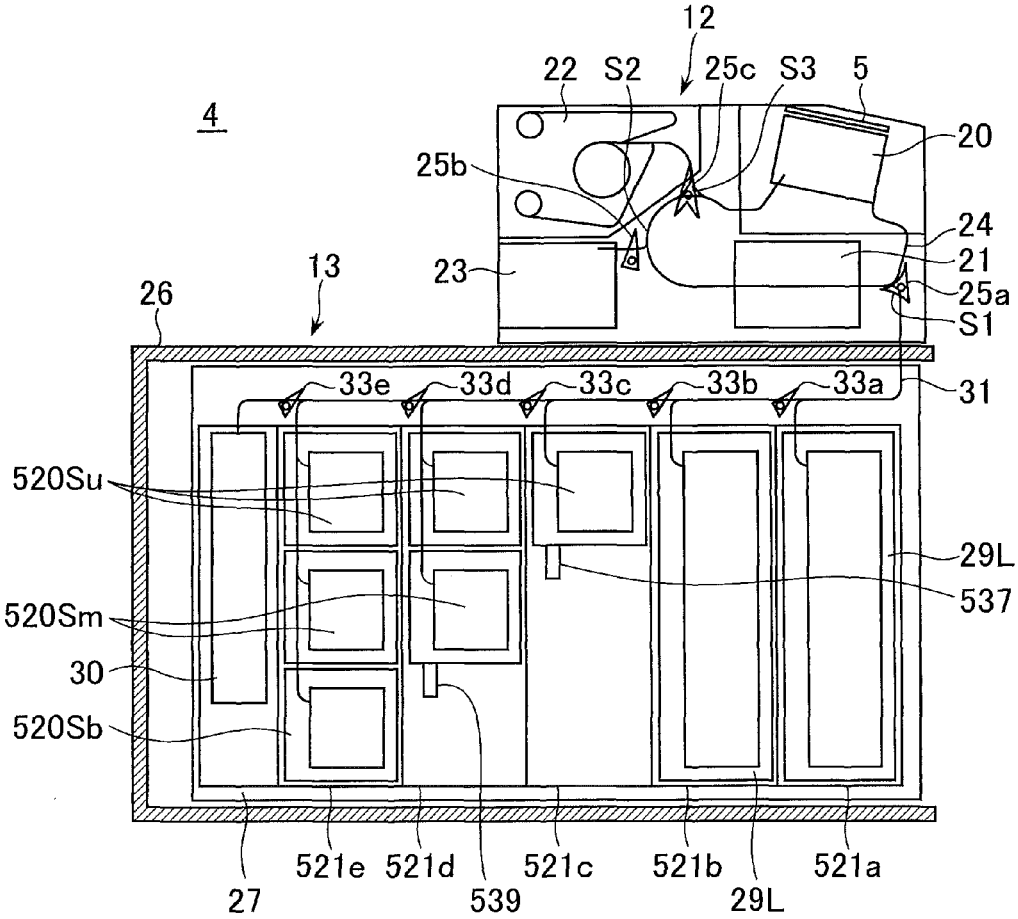
FIG. 16 is a schematic side view, like FIG. 2, showing another alternative embodiment of bill depositing and withdrawing machine in which upper, middle and lower small storing boxes are loaded in the slot.

Note that, in the alternative embodiment, the upper small storing boxes 100 include the two accumulating mechanisms and the two bill repositories 104 and 124, but the boxes 100 may be adapted to have any number of, e.g. three as shown in FIG. 16 or more, accumulating mechanisms and repositories provided in the vertical direction.

FIG. 16 is a schematic side view, like FIG. 2, showing the bill depositing and withdrawing machine of another alternative embodiment. In the figure, the slot 521*e* has loaded three small storing boxes 520S, i.e. the upper, middle and lower small storing boxes 520Su, 520Sm and 520Sb. They are loaded in one slot 521*e* such that at the bottom of the slot 521*e* the lower small storing box 520Sb is firstly loaded, on which the middle small storing box 520Sm is secondly stacked, and the upper small storing box 520Su is lastly stacked on the middle small storing box 520Sb, for example.

When being loaded in the slot 521*e*, the upper small storing box 520Su connects to the lower conveyance channel 31 and has its in-box conveyance channel 32 connecting to the in-box conveyance channel 32 of the middle small storing box 520Sm, so that the middle small storing box 520Sm connects to the lower conveyance channel 31 via the in-box conveyance channel 32 of the upper small storing box 520Su. The lower small storing box 520Sb similarly connects to the lower conveyance channel 31 via the in-box conveyance channels 32 of the upper and middle small storing boxes 520Su and 520Sm.

Each slot 521 may have substantially the same size as the slot 28 as described above, so that it is possible to load one large storing box 29L in the slot 521 as shown in FIG. 16.

Of course, the slot 521 may have one or two small storing boxes 520S as shown in FIG. 16. In the figure, the slot 521*d* has two small storing boxes 520S, for example. In the case when the two small storing boxes 520S are loaded in one slot 521, the lower small storing box 520Sb is not loaded at the bottom of the slot 521 and an area for the lower small storing box 520Sb is left blank. The middle small storing box 520Sm is then loaded at the middle of the slot 521. Further, the upper small storing box 520Su is stacked on the middle small storing box 520Sm to be loaded at the top of the slot 521. Also, the slot 521*c* has one small storing box 520S being loaded at the top of the slot 521*c*. In this case, the lower and middle small storing boxes 520Sb and 520Sm are not loaded for making blank in the slot 521*c*.

Figure 17:
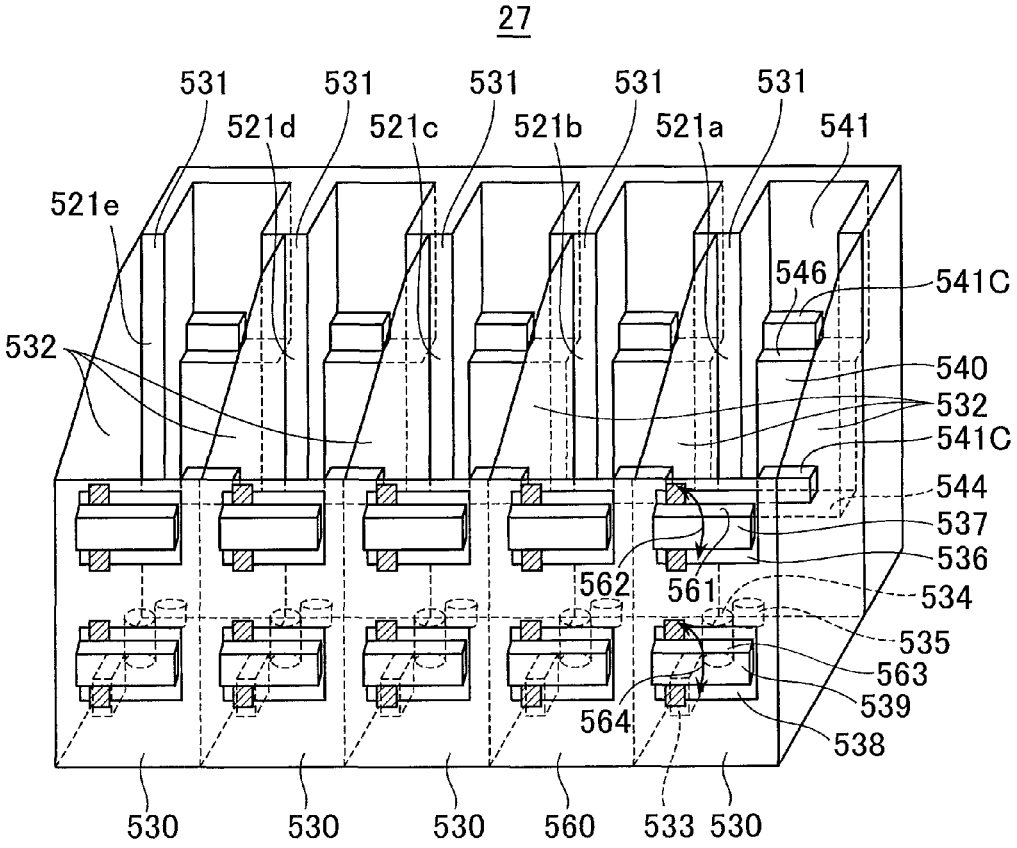
FIG. 17 is a schematic perspective view showing the configuration of slots in a bill storage of the other alternative embodiment shown in FIG. 16.

Well, reference will be made to FIG. 17 for describing circumstantially the slot 521. As shown in the figure, the slots 521*a* to 521*e* each have a generally box-like shape that has an opening at its top, a front wall 530, a back wall 531, side walls 532 and a closed bottom 560. The front wall 530 is substantially two thirds as tall as the back wall 531 in the embodiment. Accordingly, the side walls 532 have respective top edges inclining towards the front wall and connect the front wall 530 and back wall 531 with each other. Thus, the slots 521 are of a box-like shape having its front wall 530 shorter than its back wall 531 and having the opening at the top which inclines downward from the back wall 531 to the front wall 530.

The front wall 530 has a generally rectangular shape having an also generally rectangular and oblong holes 536 and 538 cut in the vicinity of the upper end and substantially middle of the wall 530, respectively. The rectangular hole 538 has substantially the same shape with the rectangular hole 536 and is formed below it. Alternatively, the rectangular holes 536 and 538, an upper lever 537 and a middle lever 539 may be turnably supported, respectively.

The upper lever 537, as with the lever 47 in FIG. 3, has an oblong plate-like shape, and is for use in supporting an upper small storing box 520Su, when only the upper small storing box 520Su is loaded in the slot 512, to function as a substitute for a middle small storing box 520Sm which would have been loaded. Thus, in the instant alternative embodiment, the upper lever 537 is arranged in the front wall 530 such that the upper lever 537 has its upper surface 561 substantially the same in height as the upper surface of the middle small storing box 520Sm when it is loaded, in order to have the upper surface 561 contacting with the bottom of the upper small storing box 520Su to support the latter.

The upper lever 537 is also pivotable in the direction of an arrow 562 such that, in the current alternative embodiment, the lever has its one end serving as a rotation axis and projects orthogonally from the front wall 530 to thereby be manually rotatable. When the upper lever 537 is rendered substantially in parallel to the front wall 530, it may be referred to as in the opened state, and when the upper lever 537 projects from the front wall 530, it may be referred to as in the closed state. Therefore, by arranging the upper lever 537 in the closed state where the lever 537 is orthogonal to the front wall 530, the lever 537 can contact with the bottom of the upper small storing box 520Su to support and hold the latter. The closed state where the upper lever 537 can support the upper small storing box 520Su is shown in FIG. 16, for example, where the upper small storing box 520Su in the slot 521*c* is supported by the upper lever 537.

Returning to FIG. 17, the middle lever 539 is for use in supporting a middle small storing box 520Sm, when the upper and middle small storing boxes 520Su and 520Sm are loaded in one slot 512, to function as a substitute for a lower small storing box 520Sb which would have been loaded. In the present alternative embodiment, the middle lever 539 thus has substantially the same shape with the upper lever 537 and is arranged in the front wall 530 such that the middle lever 539 has its upper surface 563 substantially the same in height as the upper surface of the lower small storing box 520Sb when it is loaded, in order to have the upper surface 563 contacting with the bottom of the middle small storing box 520Sm to support the latter.

The middle lever 539, as with the upper lever 537, is also pivotable in the direction of an arrow 564 such that, in the instant alternative embodiment, the lever has its one end serving as a rotation axis and projects orthogonally from the front wall 530 to thereby be manually rotatable. When the middle lever 539 is rendered substantially in parallel to the front wall 530, it may be referred to as in the opened state, and when the middle lever 539 projects from the front wall 530, it may be referred to as in the closed state. Therefore, by arranging the middle lever 539 in the closed state, the lever 539 can contact with the bottom of the middle small storing box 520Sm to support and hold the latter. The closed state where the middle lever 539 can support the middle small storing box 520Sm is shown in FIG. 16, for example, where the upper and middle small storing boxes 520Su and 520Sm in the slot 521*d* are supported by the lever 539.

Returning to FIG. 17, the back wall 531 has a generally rectangular shape having grooves 540 and 541 which are formed in its inner surface. The grooves 540 and 541 are rectangle having back, sides and bottom 544 and 546, respectively, so as to form a stepped terrain. Specifically, the groove 540 is formed at the middle of the wall 531 and the groove 541 is formed above the groove 540 and on the recessed back side from it.

At the bottom 544 of the groove 540, a slot-side connector 540C is arranged, which has an electric interface for electrically connecting to the middle small storing box 520Sm. In the instant alternative embodiment, the connector 540C is located so as to be connectable with a box-side connector, described later, of the middle small storing box 520Sm when the middle small storing box 520Sm is loaded in the middle portion in the slot 521.

Similarly, at the bottom 546 of the groove 541, a slot-side connector 541C is arranged, which has an electric interface for electrically connecting to the upper small storing box 520Su. In the instant alternative embodiment, the connector 541C is located so as to be connectable with a box-side connector, described later, of the upper small storing box 520Su when the upper small storing box 520Su is loaded in the upper portion in the slot 521.

The arrangements of the connector 540C and 541C in the grooves 540 and 541, respectively, formed in the inner wall of the back wall 531 make it possible to prevent, when the box 29L or 520S is loaded in the slot 521, a physical interference from arising between the connector 540C, 541C and the box 29L or 520S.

The bottom 560 of the respective slots 521*a* to 521*e* has the slot-side connector 533, a stage motor 534 and a drive transmitter 535 which are arranged at respective, predetermined positions and are substantially the same as the slot-side connector 43, the stage motor 44 and the drive transmitter 55, respectively, shown in FIG. 3.

Specifically, the connector 533 has an electric interface for establishing an electrical connection to the large storing box 29L or lower small storing box 520Sb when loaded in the slot 521. The stage motor 534 serves to generate the driving force for moving the stage 70, FIGS. 6A and 19, in the large storing box 29L and the lower small storing box 520Sb. The drive transmitter 535 is adapted for transmitting the driving force generated by the stage motor 534 to the large storing box 29L or the lower small storing box 520Sb.

The slot 521 may have the same components as the slot 210, FIG. 5, of the prior art other than the levers 537, 539 and grooves 540, 541 as well as the connectors 540C, 541C whereby it is possible to load the conventional storing box in the slot 521 as the large storing box.

Figure 18A:
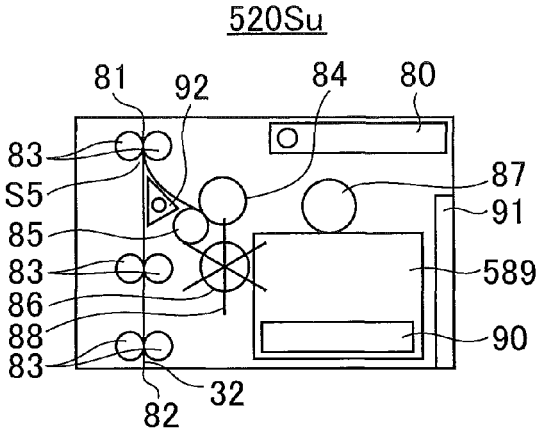
FIGS. 18A, 18B and 18C are schematic side views, like FIGS. 7A, 7B and 7C, showing the configuration of a small storing box for upper portion in accordance with the other alternative embodiment.
Figure 18B:
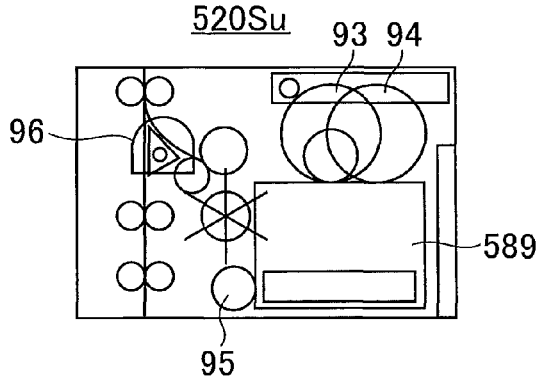
Figure 18C:
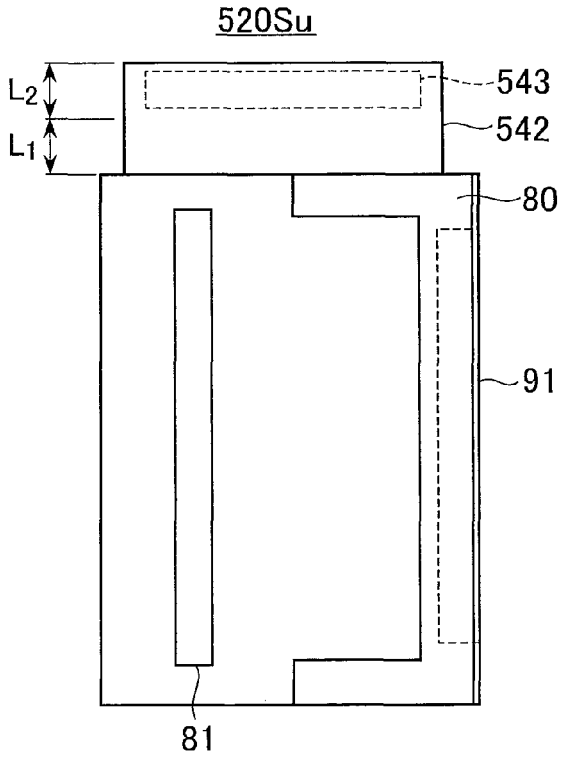

Next, reference will be made to FIGS. 18A, 18B and 18C for describing the upper small storing box 520Su. The upper small storing box 520Su may be substantially the same as the upper small storing box 29Su except for its height and a protrusion 542.

Specifically, the upper mall storing box 520Su has its height, i.e. tallness or vertical length, substantially shorter than that of the upper small storing box 29Su. In the present alternative embodiment, the upper mall storing box 520Su has its height substantially two thirds as much as that of the upper small storing box 29Su. Therefore, the bill repository 589 has its height substantially two thirds as much as that of the repository 89 in the upper small storing box 29Su, too.

The upper small storing box 520Su also has a protrusion 542 which has a depth of about 2 times (2L in the figure) the depth ($L_1$) of the projection 97 in the upper side for small storage cassette 29Su. The protrusion 542 has a shape fittable into the groove 541C formed in the back wall 531 shown in FIG. 17, and specifically has a generally rectangular parallelepiped having a top plate on which a connector 543 is arranged at the side of $L_2$, which is the back side in the projection. The connector 543 is a box-side connector for connecting to the slot-side connector 541C. In the present alternative embodiment, the connector 543 is also connected to the roller motors 93 and 94, stage motor 95 and swing selector 96 so as to transmit to them an electric power and a control signal supplied from the ATM 1. Therefore, the upper small storing box 520Su thus receives the electric power and the control signal from the ATM 1 to drive the roller motors 93 and 94, stage motor 95 and swing selector 96 to rotate the conveyance rollers 83 and the separating and accumulating rollers 84 to 88 to thereby move the stage 90 and operate the switch 92.

The upper small storing boxes 520Su are configured in that way. Thus, the upper small storing box 520Su, when loaded in the upper portion in the slot 521, causes the protrusion 542 to fit into the upper groove 541 in the slot 521, and the box-side connector 543 to be connected to the slot-side connector 541C provided in the upper groove 541 in the slot 521 and the upper bill entering and exiting slot 81 to be connected to the conveyance channel 31. The upper small storing box 520Su operates as the upper small storing box 29Su to perform bill accumulation and feeding. The upper small storing boxes

Figure 19:
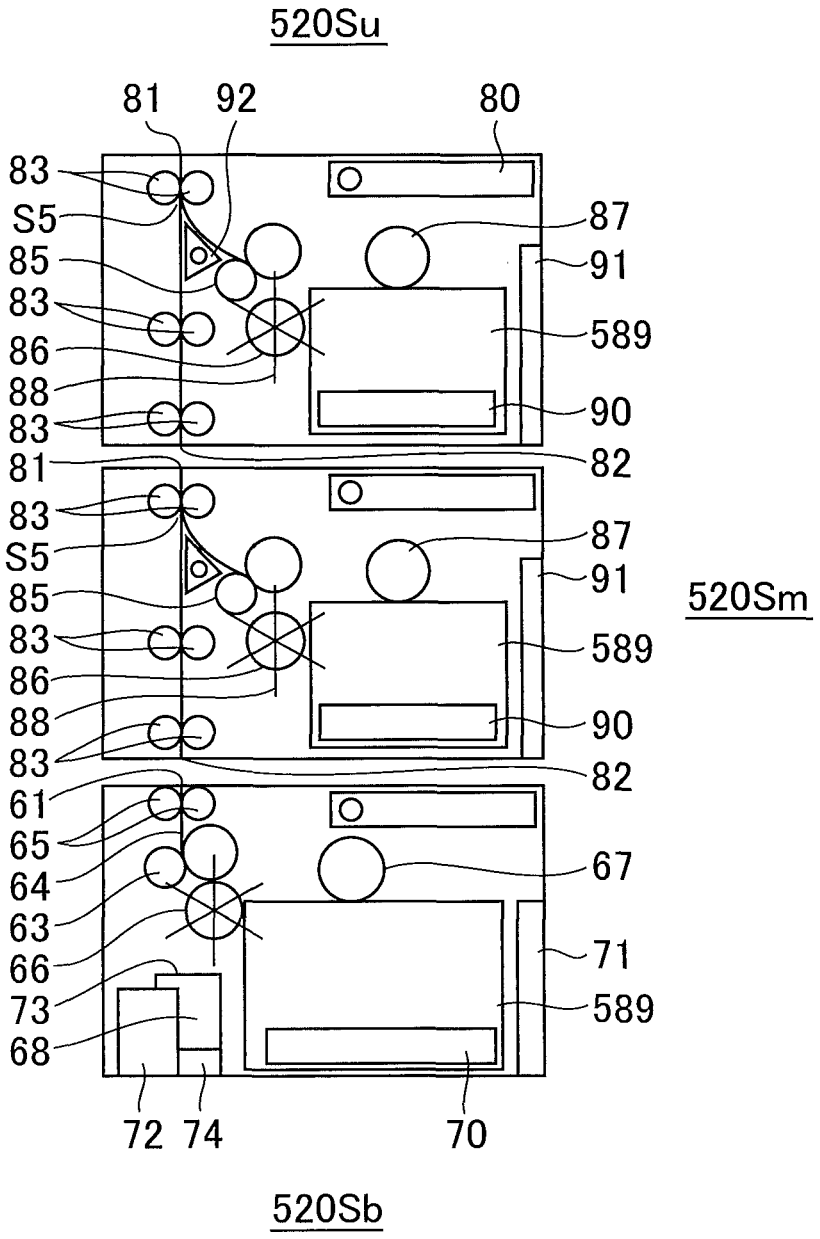
FIG. 19 is schematic side view, like FIG. 9, showing the small storing boxes for upper, middle and lower portion stacked one above the other in the other alternative embodiment.

520Su also work as a conveyance channel between the conveyance channel 31 and the middle small storing boxes 520Sm as shown in FIG. 19.

Next, the middle and lower small storing boxes 520Sm and 520Sb will be described. As shown in FIG. 19, the middle and lower small storing boxes 520Sm and 520Sb may be substantially the same as the upper and lower small storing boxes 29Su (FIG. 8), 29Sb (FIG. 7), respectively, except for their height.

Specifically, the middle small storing boxes 520Sm have the height, i.e. vertical length, substantially shorter than that of the upper small storing box 29Su. In the instant alternative embodiment, the middle small storing boxes 520Sm are substantially two thirds as tall as the upper small storing box 29Su, that is, substantially equal to one-third height of the large storing box 29L. Therefore, the bill repository 589 has its height substantially equal to two-thirds height of the repository 89 in the upper small storing box 29Su, too.

The middle small storing boxes 520Sm configured in that way, when loaded in the middle portion in the slot 521, causes the protrusion 97, FIG. 8, to fit into the middle groove 540 in the slot 521, and the connector 98 to be connected to the slot-side connector 540C provided in the middle groove 540 in the slot 521. The middle small storing box 520Sm operates as the upper small storing box 29Su to perform bill accumulation and feeding. The middle small storing boxes 520Sm also work as a conveyance channel between the upper small storing boxes 520Su and the lower small storing boxes 520Sb as shown in FIG. 19.

The lower small storing boxes 520Sb may similarly have the height substantially shorter than that of the lower small storing box 29Sb. In the current alternative embodiment, the lower small storing boxes 520Sb have the height substantially equal to two-thirds height of the lower small storing box 29Sb, that is, substantially one third as tall as the large storing box 29L. Therefore, the bill repository 569 has its height substantially equal to two-thirds height of the repository 69 in the lower small storing box 29Sb, too.

The lower small storing boxes 520Sb configured in that way, when loaded in the lower portion in the slot 521, causes the box-side connector 72 to be connected to the slot-side connector 533 provided in the bottom 560 in the slot 521, and the drive transmitter 74 of box-side to be connected to the drive transmitter 535 provided in the bottom 560 in the slot 521. The lower small storing box 520Sb operates as the lower small storing box 29Sb to perform bill accumulation and feeding.

In the instant alternative embodiment, these storing boxes 29L, and 520Su, 520Sm and 520Sb may have respective ID numbers specific thereto whereby the controller 10 can distinguish them from each other, and may have the doors 71 and 91, respectively, locked with respective keys specific thereto. When the respective doors 71 of the large storing box 29L and the lower small storing boxes 520Sb, and the respective doors 91 of the upper and middle small storing boxes 520Su and 520Sm are adapted to be locked with such a different key, the security will be enhanced. Of course, the doors 71 and 91 may be locked with a one common key.

According to the embodiment shown in and described with reference to FIGS. 16-19, the respective slots 521*a*-521*e* can have at most three small storing boxes 29S having one-third size of the large storing box 29S and hence the bill depositing and withdrawing machine according to the instant alternative embodiment can handle extensive denominations of bills and attain more variety of using modes than the conventional machines.

As described so far, the present invention is directed to the bill depositing and withdrawing machine 4 provided in the ATM 1 to serve as a bill processor. The present invention may also be applied to any various sorts of machines or equipment in which a box or like enclosure for storing sheet-like media can be detachably loaded in a slot.

The entire disclosure of Japanese patent application Nos. 2012-120891 and 2013-81221 filed on May 28, 2012 and Apr. 9, 2013, respectively, including the specifications, claims, accompanying drawings and abstracts of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A medium processor comprising:

a conveyance channel conveying a medium;

medium-storing boxes removably set in said processor and communicating with said conveyance channel, said medium-storing boxes storing the medium conveyed on said conveyance channel; and a medium storage including a plurality of slots;

wherein one or more slots of said plurality of slots are capable of detachably housing said medium-storing boxes such that said medium-storing boxes are stacked one above the other in a vertical direction;

wherein said one or more slots include a connector, said connector providing electric power to at least one of said medium-storing boxes and not providing electric power to a lower medium-storing box which is loaded in a lower portion of said one or more slots; and wherein said connector is located in a groove.

2. A medium-storing box for use in a medium processor to store a medium, said medium processor including a medium storage having a slot in which said boxes are detachably loaded in plural and stacked one above the other in a vertical direction, said medium-storing box comprising:

said medium processor according to claim 1;

an upper and a lower medium-entering and exiting slot disposed in a top and a bottom portion of said medium-storing box, respectively;

a box-side connector connecting to said connector that is provided in said groove; and an in-box conveyance channel connecting said upper medium entering and exiting slot to said lower medium entering and exiting slot.

3. The medium-storing box according to claim 2, wherein:

said box is used as an upper small storing box to be loaded in an upper portion of said slot and stacked on a lower small storing box, and, when said upper small storing box is stacked on the lower small storing box to be loaded in the slot, said in-box conveyance channel in said upper small storing box conveys the medium to the lower small storing box to be stored therein; and said lower small storing box includes a box-side connector that connects to a slot-side connector provided in the slot.

4. A medium-storing box for use in a medium processor to store a medium, said medium processor including a medium storage having a slot in which said boxes are detachably loaded in plural and stacked one above the other in a vertical direction, said medium-storing box comprising:

said medium processor according to claim 1;

an upper medium-entering and exiting slot disposed in a top portion of said medium-storing box; and a box-side connector connecting to a slot-side connector that is provided in said slot;

wherein when said medium-storing box is used as a lower small storing box and said lower small storing box is loaded in a lower portion of the slot under an upper small storing box, said upper medium-entering and exiting slot connects to a lower medium-entering and exiting slot disposed in a bottom portion of the upper small storing box.

5. The medium processor according to claim 1, wherein:

said one or more slots of said plurality of slots house a large medium-storing box which is dimensioned to be loaded in single into said one or more slots; and first connector that provides electric power to said large medium-storing box is located at a bottom of said one or more slots.

6. The medium processor according to claim 1, wherein:

said one or more slots of said plurality of slots house a lower medium-storing box which is loaded in a lower portion of said one or more slots and a large medium-storing box which is dimensioned to be loaded in single into said one or more slots, and said one or more slots include a second connector that provides electric power to said lower medium-storing box and said large medium-storing box; and when said lower medium-storing box is set in said one or more slots, said second connector provides electric power to said lower medium-storing box.

7. The medium processor according to claim 6, wherein:

said second connector is located at a bottom of said one or more slots.

8. The medium processor according to claim 1, wherein:

said medium-storing boxes include a lower medium-storing box which is loaded in a lower portion of said one or more slots and other medium-storing boxes which are loaded in the other portions of said one or more slots; and a repository of said lower medium-storing box is larger than a repository of said other medium-storing boxes.

9. The medium processor according to claim 8, wherein:

said other medium-storing boxes include an upper medium-storing box which is loaded in an upper portion of said one or more slots and a middle medium-storing box which is loaded in a middle portion of said one or more slots.

* * * * *